US008170461B2

(12) United States Patent
Yoshikawa

(10) Patent No.: US 8,170,461 B2
(45) Date of Patent: May 1, 2012

(54) IMAGE FORMING APPARATUS INCLUDING PRE-HEATING UNIT

(75) Inventor: Takahiro Yoshikawa, Sagamihara (JP)

(73) Assignee: Ricoh Company, Limited, Tokyo (JP)

( * ) Notice: Subject to any disclaimer, the term of this patent is extended or adjusted under 35 U.S.C. 154(b) by 338 days.

(21) Appl. No.: 12/458,250

(22) Filed: Jul. 7, 2009

(65) Prior Publication Data

US 2010/0008683 A1 Jan. 14, 2010

(30) Foreign Application Priority Data

Jul. 8, 2008 (JP) ..... 2008-177449

(51) Int. Cl.
*G03G 15/00* (2006.01)

(52) U.S. Cl. ..... 399/390; 399/45; 399/69; 219/216

(58) Field of Classification Search ..... 399/38, 399/45, 67–69, 75, 94, 122, 308, 320, 328–331, 399/388–390; 219/216, 244
See application file for complete search history.

(56) References Cited

U.S. PATENT DOCUMENTS

| | | | | |
|---|---|---|---|---|
| 5,873,017 | A * | 2/1999 | Soga et al. | 399/302 |
| 5,907,348 | A * | 5/1999 | Ogasawara et al. | 347/212 |
| 6,160,974 | A | 12/2000 | Yoshikawa et al. | |
| 6,823,149 | B2 | 11/2004 | Yoshikawa et al. | |
| 7,233,762 | B2 * | 6/2007 | Kunii et al. | 399/307 |
| 7,292,801 | B2 | 11/2007 | Yoshikawa | |
| 2002/0159785 | A1 * | 10/2002 | Masuda et al. | 399/69 |
| 2003/0161649 | A1 | 8/2003 | Yoshikawa et al. | |
| 2004/0175208 | A1 * | 9/2004 | Ichida et al. | 399/302 |
| 2004/0264991 | A1 | 12/2004 | Yoshikawa | |
| 2006/0013607 | A1 | 1/2006 | Yoshikawa | |
| 2007/0274748 | A1 | 11/2007 | Yoshikawa | |
| 2008/0031647 | A1 | 2/2008 | Yoshikawa | |
| 2008/0101814 | A1 | 5/2008 | Yoshikawa | |
| 2009/0052927 | A1 | 2/2009 | Yoshikawa | |

FOREIGN PATENT DOCUMENTS

| | | |
|---|---|---|
| JP | 2003-167459 | 6/2003 |
| JP | 2005-308920 | 11/2005 |
| JP | 2006-091360 | 4/2006 |
| JP | 2006-337898 | 12/2006 |
| JP | 2007-079135 | 3/2007 |
| JP | 2007-147771 | 6/2007 |
| JP | 2007-187751 | 7/2007 |

* cited by examiner

*Primary Examiner* — David Porta
*Assistant Examiner* — Benjamin Schmitt
(74) *Attorney, Agent, or Firm* — Harness, Dickey & Pierce, P.L.C.

(57) ABSTRACT

An image forming apparatus includes an image carrying member, a transfer unit, a pre-heating unit, a fixing unit, a first temperature sensor, and a first heat controller. The image carrying member carries a toner image. The transfer unit transfers the toner image carried on the image carrying member to a recording medium transported to a transfer position. The pre-heating unit selectively heats the recording medium before the recording medium is transported to the transfer position. The fixing unit fixes the toner image on the recording medium. The first temperature sensor detects temperature of the recording medium as the recording medium passes through the pre-heating unit. The first heat controller changes an amount of heat energy to be applied to the recording medium per unit area of the recording medium by the pre-heating unit. The first heat controller is controlled based on a detection result of the first temperature sensor.

19 Claims, 10 Drawing Sheets

IMAGE FORMING APPARATUS INCLUDING PRE-HEATING UNIT

CROSS-REFERENCE TO RELATED APPLICATIONS

This application claims priority to Japanese Patent Application No. 2008-177449, filed on Jul. 8, 2008 in the Japan Patent Office, the entire contents of which are hereby incorporated by reference herein.

BACKGROUND OF THE INVENTION

1. Field of the Invention

The present invention relates to an image forming apparatus employing a pre-heating unit to heat a recording medium before the recording medium is transported to a transfer position.

2. Description of the Background Art

Image forming apparatuses such as copiers, printers, facsimile machines, and multi-functional apparatuses including at least two of these functions have been commercially available for some time. Such image forming apparatuses typically use a fixing unit to fix an image onto a recording medium. The fixing unit is either oil-using fixing system or oil-less fixing system. In the oil-using fixing system, a separation film is formed on a fixing roller using silicone oil or the like. In the oil-less fixing system, instead of forming a separation film on the fixing roller, toner-particles including wax are used to enhance separation of toner (e.g., melted toner) from the surface of the fixing roller.

In the oil-less fixing system, a so-called hot-offset phenomenon is more likely to occur during the fixing process due to the physical properties of the waxed toner particles. Hot-offset phenomenon is a phenomenon that toner adheres to a fixing member such as fixing roller although the toner is supposed to be fixed onto a recording medium such as sheet paper. Further, such hot-offset phenomenon is more likely to occur when a fixing temperature of the fixing roller is set higher than usual. Although the higher fixing temperature of the fixing roller is preferred because it enhances glossiness of the output images, the hot-offset phenomenon is more likely to occur at higher temperatures. Accordingly, it becomes hard to increase the fixing temperature of the fixing roller beyond a given temperature level.

In color image forming apparatuses, toner particles having a plurality of colors, superimposed on a recording medium, are melted and mixed to form a given color image. In some cases, the amount of toner adhering to the color image may vary from one portion of the image to another, that is, a toner layer composed of toner particles may vary in thickness, creating some areas of relatively greater thickness. Put another way, a distance between the two surfaces of the toner layer, that is, an upper toner face of the toner layer contacting the fixing roller and a lower toner face of the toner layer contacting the recording medium, is increased. When heat energy is applied to such toner layer in a short time, too great heat energy may be applied to the upper toner face without transmitting sufficient heat energy to the lower toner face, hot-offset phenomenon may occur.

Accordingly, in the color image forming apparatus using the oil-less fixing system, lower heat energy is applied for an extended-time period to an output image to enhance glossiness of the output image. However, such method decreases a transport speed of the recording medium, thus decreasing productivity.

In view of such inconvenience, several approaches have been proposed.

For example, JP-2003-167459-A describes a system using two fixing units. In such configuration, a recording medium carrying an un-fixed toner image is passed through the two fixing units, by which the recording medium carrying the un-fixed toner image can be heated for an extended heating time to enhance glossiness of the output image.

Further, JP-2006-91360-A describes a two-step system to enhance glossiness of the output image. Specifically, a fixing process is conducted for a recording medium carrying an un-fixed toner image, and then a back face of the recording medium is reheated to enhance glossiness of the output image.

Further, JP-2007-187751-A describes a system to heat a recording medium before transferring an image to the recording medium in order to prevent image position displacement between a front face and a back face of the recording medium.

However, in such conventional image forming apparatuses, there is a trade-off among productivity, hot-offset phenomenon, and glossiness. That is, for example, if a higher gloss image is to be produced by increasing the fixing temperature, hot-offset phenomenon may occur; by contrast, when priority is placed on preventing hot-offset phenomenon, productivity may be decreased due to a lower fixing temperature, by which higher gloss image may not be reliably produced. As such, in the conventional image forming apparatuses, enhancement of glossiness of the output image and prevention of hot-offset phenomenon may not be achieved at the same time, or enhancement of glossiness of the output image and higher productivity of image may not be achieved at the same time.

Specifically, in JP-2003-167459-A and JP-2006-91360 discussed above, hot-offset phenomenon is more likely to occur when heat energy is applied to an upper face of the toner image formed on the recording medium during a second fixing process. Further, the toner particles of the toner image on the recording medium may become gel when the recording medium is transported from a first fixing unit to a second fixing unit, wherein the first fixing unit is set at an upstream of a transport route of the recording medium, and the second fixing unit is set at a downstream of a transport route of the recording medium. When the toner particles of the toner image on the recording medium become gel, the toner is more likely to adhere to parts configuring the transport route, which is undesirable.

In JP-2007-187751-A, the recording medium is heated before transfer of an image to the recording medium, thus enhancing glossiness of the output image for the purpose of preventing image position displacement between a front face and a back face of the recording medium. However, the temperature to which the recording medium is heated is uncontrolled for image forming process, and therefore does not provide a complete solution to the above-described problems.

SUMMARY

In one aspect of the present invention, an image forming apparatus includes an image carrying member, a transfer unit, a pre-heating unit, a fixing unit, a first temperature sensor, and a first heat controller. The image carrying member carries a toner image. The transfer unit transfers the toner image carried on the image carrying member to a recording medium transported to a transfer position. The pre-heating unit selectively heats the recording medium before the recording medium is transported to the transfer position. The pre-heating unit includes a heating member, a pressure member, a first heat source for heating the heating member. The fixing unit fixes the toner image, transferred to the recording medium at the transfer position, on the recording medium. The first temperature sensor detects temperature of the recording medium as the recording medium passes through the pre-heating unit. The first heat controller changes an amount of heat energy to be applied to the recording medium per unit area of the recording medium by the pre-heating unit by controlling at least one of heating power of the first heat source and a pressing condition between the heating member and the pressure member. The first heat controller is controlled based on a detection result of the first temperature sensor.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
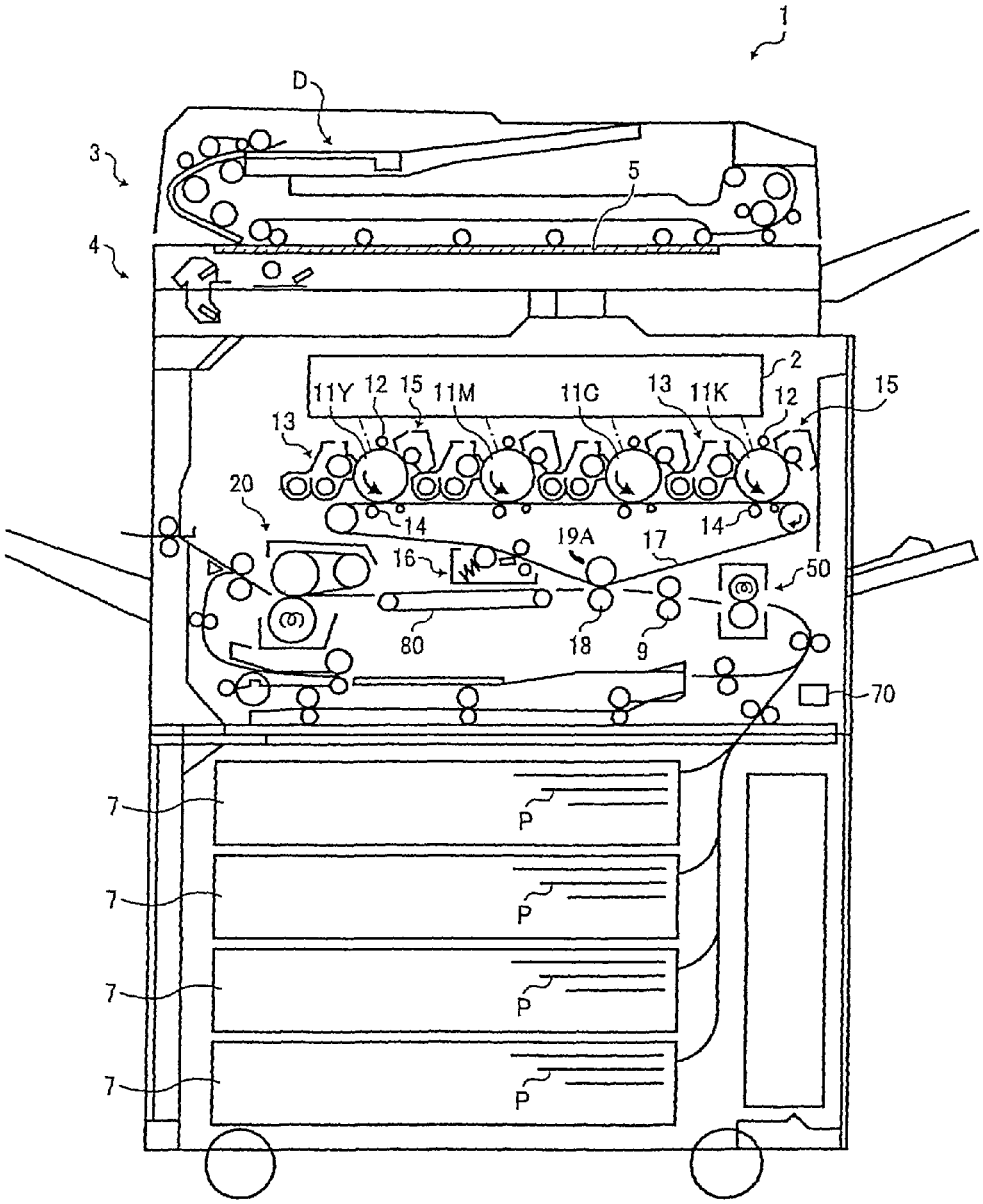
FIG. 1 illustrates a schematic configuration an image forming apparatus according to a first example embodiment.

The accompanying drawings are intended to depict example embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXAMPLE EMBODIMENTS

A description is now given of example embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing expanded views shown in the drawings, specific terminology is employed for the sake of clarity, the present disclosure is not limited to the specific terminology so selected and it is to be understood that each specific element includes all technical equivalents that operate in a similar manner.

Referring now to the drawings, an image forming apparatus according to an example embodiment is described. The image forming apparatus may employ electrophotography, for example, and may be used as a copier, a printer, a facsimile, or a multi-functional imaging apparatus which may include copy and facsimile function, but not limited thereto. The image forming apparatus may be color copier having a tandem arrangement, but not limited these.

An image forming apparatus 1 according to a first example embodiment is described with reference to FIGS. 1 to 7. As shown in FIG. 1, the image forming apparatus 1 may include a writing unit 2, a document feeder 3, a document scanner 4, a sheet feed unit 7, a registration roller 9, photoconductor drums 11Y, 11M, 11C, and 11K, a charge unit 12, a development unit 13, a primary transfer roller 14, and a cleaning unit 15, for example.

The writing unit 2 emits a laser beam based on input image information. The document feeder 3 transports a document sheet D to the document scanner 4. The document scanner 4 scans image information on the document sheet D. The sheet feed unit 7 stores a given volume of recording medium P such as for example transfer sheets. The registration roller 9 adjusts a transport timing of the recording medium P. The photoconductor drums 11Y, 11M, 11C, and 11K form toner image of yellow, magenta, cyan, and black. The charge unit 12 charges the photoconductor drums 11Y, 11M, 11C, and 11K. The development unit 13 develops a latent image on the photoconductor drums 11Y, 11M, 11C, and 11K as toner image. The primary transfer roller 14 transfers toner images formed on the photoconductor drums 11Y, 11M, 11C, and 11K to the recording medium P while superimposing the toner images. The cleaning unit 15 recovers toner remaining on the photoconductor drums 11Y, 11M, 11C, and 11K after a primary transfer process.

Further, the image forming apparatus 1 may include an intermediate transfer belt 17, an intermediate transfer belt cleaning unit 16, a secondary transfer roller 18, a secondary transfer counter roller 19A, a fixing unit 20, and a pre-heating unit 50.

The intermediate transfer belt cleaning unit 16 cleans the intermediate transfer belt 17. The intermediate transfer belt 17 is used as an image carrying member, onto which a plurality of color toner images are superimposed from on the photoconductor drums 11Y, 11M, 11C, and 11K. The secondary transfer roller 18 transfers the color toner image from the intermediate transfer belt 17 to the recording medium P. The fixing unit 20 fixes toner image (un-fixed toner image) on the recording medium P. The pre-heating unit 50 heats the recording medium P before the recording medium P is transported to a transfer position set by the secondary transfer roller 18.

A description is now given to a normal mode operation of the image forming apparatus 1, in which a color image may be formed.

At first, the document sheet D is placed on a document tray of the document feeder 3. Then, the document sheet D is transported by a transport roller of the document feeder 3 to a contact glass 5 of the document scanner 4. The document sheet D, placed on the contact glass 5, is scanned by the document scanner 4 to optically read image information on the document sheet D.

Specifically, the document scanner 4 scans image on the document sheet D by irradiating light from a lighting lamp. Reflection light reflected from the document sheet D is focused on a color sensor via mirrors and lens. Color image information included in the document sheet D is read by the color sensor for each of light colors of RGB (red, green, blue), and then converted to electrical image signals. Further, such image signals are processed by an image processing unit, which conducts color conversion processing, color correction processing, space frequency correction processing, or the like. Then, color image information of yellow, magenta, cyan, and black is obtained.

The color image information of yellow, magenta, cyan, and black is transmitted to the writing unit 2. Based on the color image information of yellow, magenta, cyan, and black, the writing unit 2 emits a laser beam (or exposure light), corresponding to each of colors, to the photoconductor drums 11Y, 11M, 11C, and 11K.

On one hand, the photoconductor drums 11Y, 11M, 11C, and 11K are rotated in a clockwise direction in FIG. 1. The charge unit 12 uniformly charges surface of the photoconductor drums 11Y, 11M, 11C, and 11K to set a given charge potential on the photoconductor drums 11Y, 11M, 11C, and 11K (charging process). The charged surface of photoconductor drums 11Y, 11M, 11C, and 11K comes to a position to be radiated by a laser beam emitted for each color. For example, the writing unit 2 may include four light sources used for each of four colors, and laser beams generated, based on the image signal of each of four colors, are emitted. The laser beams generated for each of yellow, magenta, cyan, and black pass through different light paths (exposure process).

A laser beam of yellow component irradiates a surface of the photoconductor drum 11Y. The laser beam of yellow component, reflected by a polygon mirror rotating at high speed, scans the photoconductor drum 11Y in a rotation shaft direction (or a main scanning direction) to form a latent image of yellow component on the photoconductor drum 11Y charged by the charge unit 12.

Similarly, a laser beam of magenta component irradiates a surface of the photoconductor drum 11M to form a latent image of magenta component. Similarly, a laser beam of cyan component irradiates a surface of the photoconductor drum 11C to form a latent image of cyan component. Similarly, a laser beam of cyan black component irradiates a surface of the photoconductor drum 11K to form a latent image of black component.

Each of the photoconductor drums 11Y, 11M, 11C, and 11K having formed with respective latent images comes to a position facing the development unit 13. The development unit 13 supplies toner on the latent images on the photoconductor drums 11Y, 11M, 11C, and 11K to develop the latent images as toner images on the photoconductor drums 11Y, 11M, 11C, and 11K (development process).

After the development process, the photoconductor drums 11Y, 11M, 11C, and 11K rotates and comes to a position facing the intermediate transfer belt 17 used as an image carrying member. At such facing position, the primary transfer roller 14, contacting an inner face of the intermediate transfer belt 17, is disposed for each of the photoconductor drums 11Y, 11M, 11C, and 11K. With an effect of the primary transfer roller 14, toner images formed on the photoconductor drums 11Y, 11M, 11C, and 11K are sequentially and superimposingly transferred on the intermediate transfer belt 17 (primary transfer process).

After the primary transfer process, the photoconductor drums 11Y, 11M, 11C, and 11K comes to a position facing the cleaning unit 15. The cleaning unit 15 removes and recovers toner remaining on the photoconductor drums 11Y, 11M, 11C, and 11K (cleaning process). Then, the photoconductor drums 11Y, 11M, 11C, and 11K is de-charged by a decharger unit, and then an image forming process for the photoconductor drums 11Y, 11M, 11C, and 11K ends.

On one hand, after the primary transfer process, the intermediate transfer belt 17 travels in a clockwise direction in FIG. 1, and comes to a position facing the secondary transfer roller 18 used as a transfer unit, wherein such position may be referred as a transfer position. At the transfer position, a color toner image carried on the intermediate transfer belt 17 is transferred onto the recording medium P (secondary transfer process).

Figure 2:
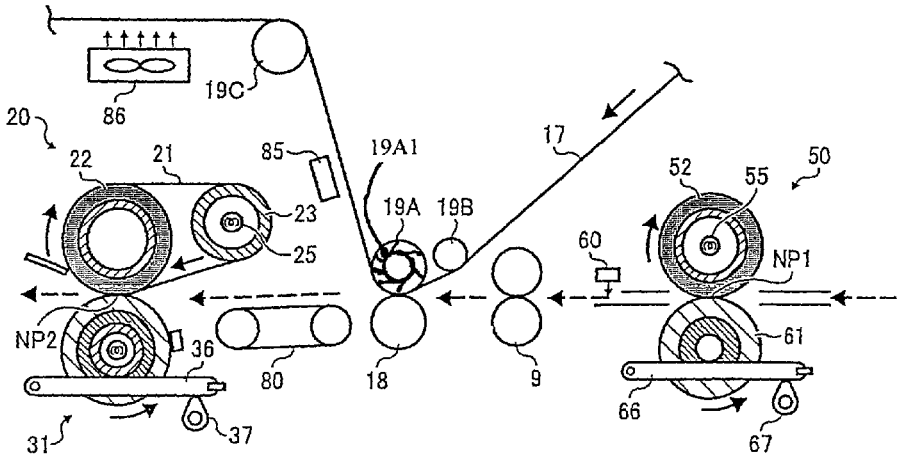
FIG. 2 illustrates a schematic view of a pre-heating unit and a fixing unit and proximity of the heating unit and fixing unit.

As shown in FIG. 2, the intermediate transfer belt 17 may be extended and supported by a plurality of rollers (e.g., secondary transfer counter roller 19A, extension roller 19B, tension roller 19C). By sandwiching the intermediate transfer belt 17 using the secondary transfer counter roller 19A and the secondary transfer roller 18, a transfer nip for secondary transfer process is formed at such sandwiched portion. After the secondary transfer process, the intermediate transfer belt 17 comes to a position facing the intermediate transfer belt cleaning unit 16. The intermediate transfer belt cleaning unit 16 recovers toner remaining on the intermediate transfer belt 17, by which a transfer process for the intermediate transfer belt 17 ends.

A description is now given to the recording medium P transported to the transfer nip (or transfer position) set between the intermediate transfer belt 17 and the secondary transfer roller 18. Specifically, the recording medium P transported to the transfer nip from the sheet feed unit 7 via the pre-heating unit 50, and the registration roller 9, for example. Specifically, the recording medium P is fed from the sheet feed unit 7 to a transport guide using a sheet feed roller, wherein the sheet feed unit 7 stores a given volume of recording medium P. Then, the recording medium P passes through the transport guide, and the pre-heating unit 50, and then the recording medium P is guided to the registration roller 9. In the pre-heating unit 50, the recording medium P may pass through a first nip NP1 set in the pre-heating unit 50, at which the recording medium P may be selectively heated before the recording medium P is fed to the transfer nip (or transfer position) in the image forming apparatus 1. The recording medium P, reached to the registration roller 9, is then transported to the transfer nip (or transfer position) at a given timing.

After transferring a full-color image at the transfer nip (or transfer position), the recording medium P is guided to the fixing unit 20 using a transport belt 80. The fixing unit 20 may include a fixing belt, and a pressure roller, in which a second nip NP2 is set between the fixing belt and the pressure roller. At the second nip NP2, a color toner image is fixed on the recording medium P (fixing process). After the fixing process, the recording medium P is ejected outside of the image forming apparatus 1 by an ejection roller as an output image, by which an image forming process completes.

Further, when the image forming apparatus 1 is operated using the normal mode, the recording medium P may not be heated by the pre-heating unit 50 before conducting the secondary transfer process; when the image forming apparatus 1 is operated by selecting a high gloss mode, the recording medium P may be heated by the pre-heating unit 50 before conducting the secondary transfer process.

An operation of the image forming apparatus 1 when the high gloss mode is selected and the pre-heating unit 50 during the high gloss mode will be described later in detail.

Figure 3:
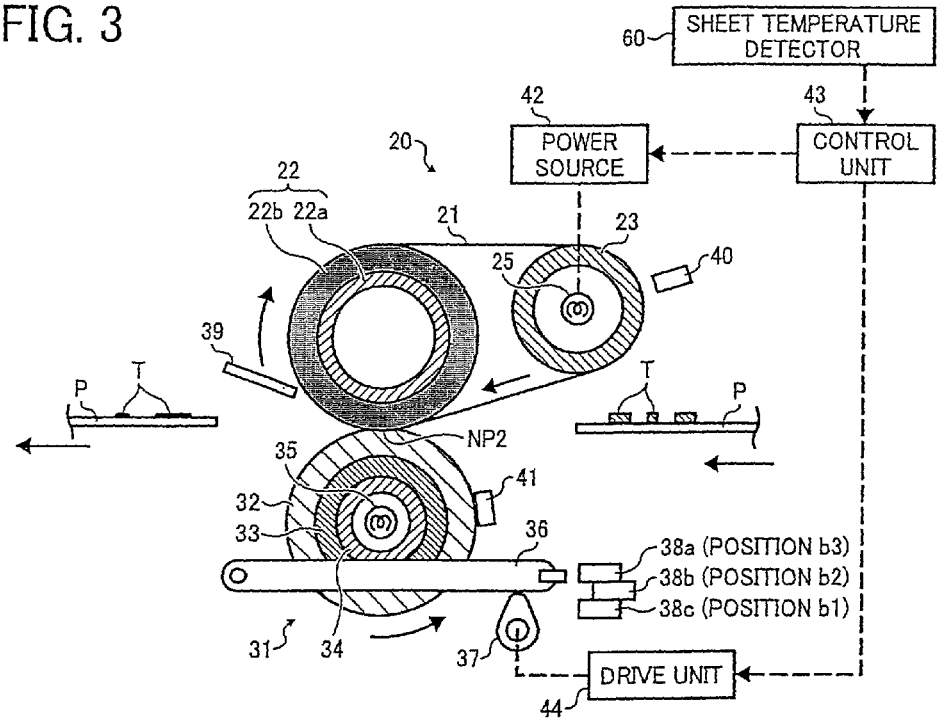
FIG. 3 illustrates a schematic configuration of the fixing unit.

A description is now given to the fixing unit 20 with reference to FIGS. 2 and 3. FIG. 2 illustrates a schematic view of the pre-heating unit 50 and the fixing unit 20 and proximity of the heating unit 50 and the fixing unit 20. FIG. 3 illustrates a schematic configuration of the fixing unit 20.

As shown in FIG. 2, the fixing unit 20 is disposed at a downstream side of transport direction of the recording medium P with respect to the transfer nip (or transfer position) set between the secondary transfer roller 18 and the intermediate transfer belt 17. As shown in FIG. 2, the pre-heating unit 50 is disposed at an upstream side of transport direction of the recording medium P with respect to the transfer nip (transfer position).

As shown in FIG. 3, the fixing unit 20 may include a fixing belt 21 (as a fixing member), a support roller 22, a heat roller 23, a pressure roller 31 (as a pressure member), position adjusting members 36 and 37, a separator 39, a thermopile 40, a thermistor 41, and first, second and third position detection sensors 38*a*, 38*b*, and 38*c*, for example.

The fixing belt 21 may be an endless belt, and forms as multi-layered structure composed of a base layer, an elastic layer formed on the base layer, and a separation layer formed on the elastic layer. The base layer of the fixing belt 21 may be made of resin material such as PI (polyimide) and PAI (polyamide-imide), or metal material such as nickel and stainless steel, and may be formed into a film shape. The elastic layer of the fixing belt 21 may be made of elastic material such as fluoro-rubber, silicone rubber, and foamed silicone rubber. The separation layer of the fixing belt 21 may be made of resin material such as PFA (tetrafluoroethylene perfluoroalkylvinylether copolymer resin), polyimide, polyetherimide, and PES (polyethersulfide). By providing the separation layer as a surface layer of the fixing belt 21, a separation performance of toner image T (toner image) from the fixing belt 21 can be secured.

The fixing belt 21 may be extended and supported by two rollers (e.g., support roller 22 and heat roller 23), and may travel in a direction shown by an arrow in FIG. 3.

The support roller 22 may include a metal core 22*a* and an elastic layer 22*b* formed on the metal core 22*a*. The metal core 22 may be made of metal such as stainless steel (e.g., SUS 304) or the like, and the elastic layer 22*b* may be made of elastic foamed material such as foamed silicone rubber or the like. The support roller 22 may sandwich the fixing belt 21 with the pressure roller 31 used as a pressure member. Such sandwiching portion may be referred to as "second nip NP2." By using elastic foamed material for the elastic layer 22*b*, a nip width at the second nip NP2 can be set relatively greater, and heat energy may less likely to transfer from the fixing belt 21 to the support roller 22. The support roller 22 may rotate in a clockwise direction in FIG. 3.

The heat roller 23 may be a hollow-structured roller having a cylindrical body made of metal material such as aluminum, stainless steel, or the like. The heat roller 23 includes a heater 25 in the cylindrical body as a second heat source. For example, the heater 25 may be a halogen heater, and both ends of the heater 25 are fixed to a sidewall of the fixing unit 20. The image forming apparatus 1 includes a power source 42 (power source of alternating current) which controls output power (i.e., heating power) of the heater 25. With such a configuration, the heater 25 generates a given radiation heat to heat the heat roller 23, and the heat roller 23 heats the fixing belt 21. The heat roller 23 may include the heater 25 as a second heat source. When the fixing belt 21 contacts a fixing face of the recording medium P, heat energy is applied onto a toner image T formed on the recording medium P.

The output power of heater 25 may be controlled using the thermopile 40 facing a surface of the fixing belt 21,in non-contact manner. Specifically, the thermopile 40 detects surface temperature of the fixing belt 21 (hereinafter, belt surface temperature), and the output power of heater 25 may be controlled based on a detection result of the thermopile 40. More specifically, based on a detection result of the thermopile 40, electric power supply time to the heater 25 is determined, and an alternating voltage is applied to the heater 25 for such determined electric power supply time. With such controlling of the output power of heater 25, surface temperature of the fixing belt 21 (or fixing temperature) can be adjusted to a given preferable temperature set as a given target temperature.

Further, the pressure roller 31, used as a pressure member, may include a metal core 33 and an elastic layer 32 formed on the metal core 33, wherein the elastic layer 32 is formed on an adhesive layer formed on the metal core 33. The elastic layer 32 may be made of elastic material such as foamed silicone rubber, fluoro-rubber, silicone rubber or the like. Further, a surface layer of the elastic layer 32 may be set as a separation layer having a thinner thickness made of material such as PFA or the like.

The pressure roller 31 can be pressed toward the support roller 22 via the fixing belt 21 using the position adjusting members 36 and 37 as a second position adjusting unit. Specifically, the second position adjusting unit may include the position adjusting members 36 and 37 as a pressure lever 36, and a cam 37, respectively. One end of the pressure lever 36 is pivot-ably supported on a sidewall of the fixing unit 20, and the other end of the pressure lever 36 is supported by the cam 37. A shaft 34 of the pressure roller 31 is placed on a center of the pressure lever 36. With such a configuration, the pressure roller 31 can be moved to an upward direction (i.e., toward the support roller 22) or downward direction, by which a preferable space can be set for the second nip NP2, which is set between the pressure roller 31 and the fixing belt 21.

Further, in the first example embodiment, the second position adjusting unit may be used as a second-nip width adjuster to change a nip width at the second nip NP2. Specifically, the cam 37 can be moved for a given rotation angle about its rotation shaft by a drive unit 44, by which the pressure lever 36 can rotate for a given angle about a rotation shaft of the pressure lever 36. With such a configuration, a pressure force applied to the fixing belt 21 from the pressure roller 31 can be changed, by which a nip width at the second nip NP2 can be changed. Accordingly, the second-nip width adjuster may include the pressure lever 36 and the cam 37. Such second-nip width adjuster may be included in a second heat controller, to be described later.

Specifically, the position detection sensors 38*a* to 38*c* (e.g., photosensor) optically detect an edge position of the pressure lever 36, and then detection results of the position detection sensors 38*a* to 38*c* are transmitted to a control unit 43. With such a configuration, the control unit 43 can control a nip width at the second nip NP2.

Further, the heat roller 31 includes a heater 35 (as a heat source) in the heat roller 31. For example, the heater 35 may be a halogen heater, and both ends of the heater 35 are fixed to a sidewall of the fixing unit 20. The image forming apparatus 1 includes the power source 42 (power source of alternating current) which controls output power (i.e., heating power) of the heater 35. With such a configuration, the heater 35 generates a given radiation heat to heat the pressure roller 31, and the pressure roller 31 heats the recording medium P from one face (referred as "non-fixing face") of the recording medium P, wherein such one face is a face that has not been transferred with a toner image T.

The heating power of heater 35 may be controlled using the thermistor 41 contacting a surface of the pressure roller 31. Specifically, the thermistor 41 detects surface temperature of the pressure roller 31 (hereinafter roller surface temperature), and the heating power of heater 35 may be controlled based on a detection result of the thermistor 41. More specifically, based on a detection result of the thermistor 41, electric power supply time to the heater 35 is determined, and an alternating voltage is applied to the heater 35 for such determined electric power supply time.

With such controlling of the heating power of heater 35, surface temperature of the pressure roller 31 can be adjusted to a given preferable temperature. By providing the heater 35 in the pressure roller 31, heat energy may be less likely to transfer from the pre-heated recording medium P to the pressure roller 31 during the high gloss mode.

Further, a guide plate for guiding the recording medium P into a transport direction is disposed at an entry side and exit side of the second nip NP2, set by the fixing belt 21 and the pressure roller 31. Further, as shown in FIG. 3, a separator 39, disposed at a position near the exit side of second nip NP2, faces the fixing belt 21. The separator 39 prevents winding of the recording medium P to the fixing belt 21 after the fixing process. If the separator 39 is not disposed, the recording medium P may stick to the fixing belt 21, and move with the fixing belt 21.

The fixing unit 20 having the above-described configuration may work as below. When a main switch is set to ON for the image forming apparatus 1, the power source 42 supplies alternating voltage to the heaters 25 and 35, and the fixing belt 21, extended by the support roller 22 and the heat roller 23, and the pressure roller 31 start to rotate in directions shown by arrows in FIG. 3.

Specifically, a drive motor rotates the pressure roller 31 directly, and then the fixing belt 21, the support roller 22, and the heat roller 23 are driven in a given direction when the pressure roller 31 rotates. Then, the recording medium P fed from the sheet feed unit 7 is transferred with toner images from the intermediate transfer belt 17, wherein the toner images are transferred to the intermediate transfer belt 17 from the photoconductor drums 11Y, 11M, 11C, and 11K at first. The recording medium P carrying the toner image T is transported into the second nip NP2 set between the fixing belt 21 and the pressure roller 31 as shown by an arrow in FIG. 3. Then, the toner image T is fixed on the recording medium P with a heat effect of the fixing belt 21 (and the support roller 22), and a pressing force effect of the fixing belt 21 and the pressure roller 31. Then, the recording medium P is further transported out of the second nip NP2 and into a direction shown by an arrow by a rotation of the fixing belt 21 and the pressure roller 31.

Figure 4:
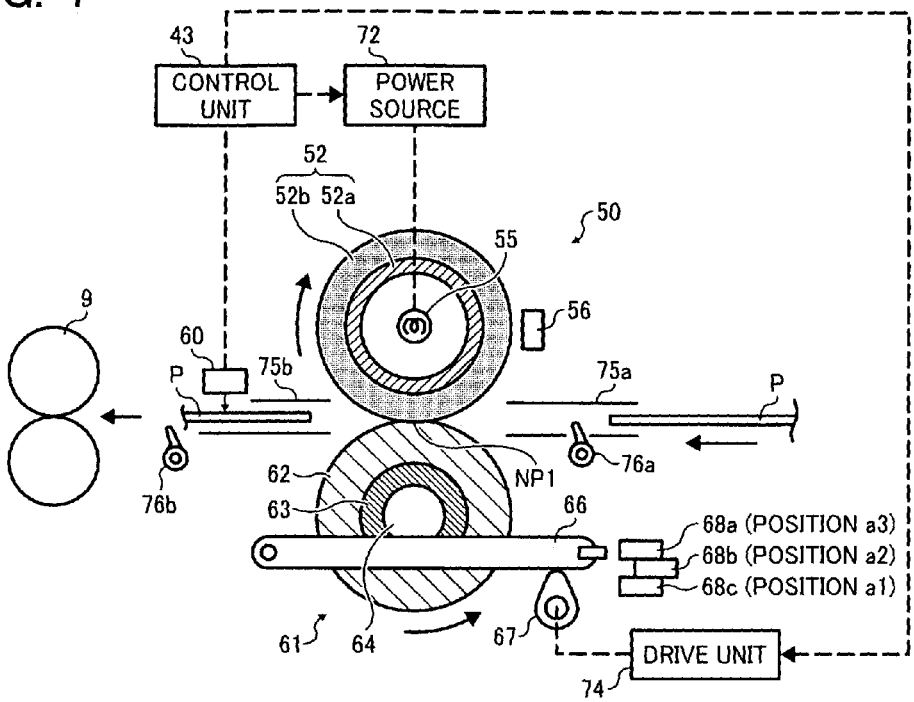
FIG. 4 illustrates a schematic configuration of the pre-heating unit.
Figure 5:
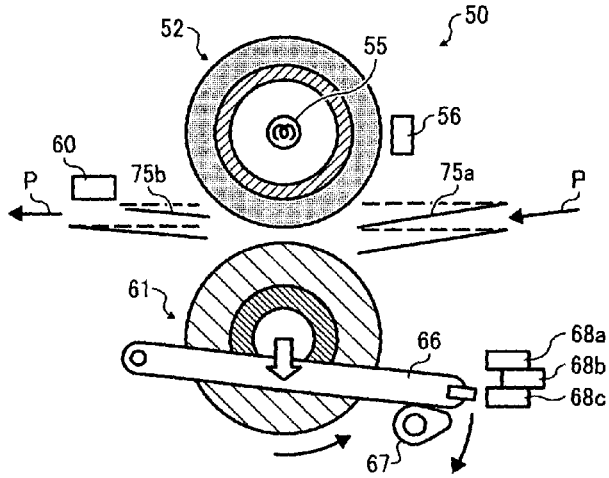
FIG. 5 illustrates a schematic configuration of the pre-heating unit at a normal mode.

A description is now given to the pre-heating unit 50 according to the first example embodiment with reference to FIGS. 4 and 5. FIG. 4 illustrates a schematic configuration of the pre-heating unit 50 during the high gloss mode. FIG. 5 illustrates the pre-heating unit 50 during the normal mode. As shown in FIG. 2, the pre-heating unit 50 is disposed at an upstream side of transport direction of the recording medium P with respect to the transfer nip (or transfer position). Specifically, the pre-heating unit 50 may be disposed at a position right before the registration roller 9.

When an operator (or user) selects the high gloss mode, the image forming apparatus 1 may conduct a pre-heating operation to the recording medium P before the recording medium P is treated by the secondary transfer process. The image forming apparatus 1 may have operation modes, which may be selectable by a user, such as the normal mode and the high gloss mode. When the high gloss mode is selected, glossiness of the output image can be enhanced.

As shown in FIG. 4, the pre-heating unit 50 may include a heat roller 52 (as heating device), a pressure roller 61 (as pressure device), position adjusting members 66 and 67, a thermopile 56, a first temperature sensor 60 (used as a sheet temperature sensor), first, second, and third position detectors 68*a*, 68*b*, and 68*c*, guide plates 75*a* and 75*b*, and sheet position detectors 76*a* and 76*b* (the sheet position detector 76*a* may be used as a first recording medium detector and sheet position detector 76*b* may be used as a second recording medium detector).

An operator that operates the image forming apparatus 1 can select one of the normal mode and high gloss mode for image forming operation. In the normal mode, the pre-heating unit 50 is not activated, and thereby the recording medium P is not heated by the pre-heating unit 50; in the high gloss mode, the pre-heating unit 50 is activated, and thereby the recording medium P is heated by the pre-heating unit 50 to output an image having higher glossiness. Specifically, the image forming apparatus 1 may include an operation panel having a button for selecting the normal mode, and another button for selecting the high gloss mode. The operator can select one of the buttons to obtain output image having a preferable image quality. Further, the normal mode may be set as default mode to set the normal mode automatically to the image forming apparatus 1 when the image forming apparatus 1 is activated. Further, a plurality of buttons may be provided for the high gloss mode on the operation panel so that a user can select and adjust glossiness step-wisely.

The heat roller 52 may include a metal core 52*a* and an elastic layer 52*b* formed on the metal core 52*a*. The metal core 52*a*, having a hollow structure, may be made of metal such as aluminum, stainless steel, or the like, and the elastic layer 52*b* may be made of elastic foamed material such as foamed silicone rubber or the like. The heat roller 52 may be pressed to the pressure roller 61 (used as pressure device), and form a "first nip NP1" between the heat roller 52 and the pressure roller 61. The heat roller 52 may be rotated in a clockwise direction in FIG. 4 when conducting the high gloss mode.

The heat roller 52 includes a heater 55 used as a first heat source. For example, the heater 55 may be a halogen heater, and both end of the heater 55 are fixed to a sidewall of the pre-heating unit 50.

The image forming apparatus 1 includes a power source unit 72 (power source of alternating current), which controls output power (i.e., heating power) of the heater 55. With such a configuration, the heater 55 generates a given radiation heat to heat the heat roller 52, and the heat roller 52 applies heat energy to the recording medium P, in which heat roller 52 contacts a transfer face of the recording medium P. The transfer face of the recording medium P is a face that receives a toner image.

The heating power of heater 55 may be controlled using the thermopile 56 facing a surface of the heat roller 52 in non-contact manner. Specifically, the thermopile 56 detects surface temperature of the heat roller 52 (hereinafter roller surface temperature), and the heating power of heater 55 may be controlled based on a detection result of the thermopile 56. More specifically, based on a detection result of the thermopile 56, electric power supply time to the heater 55 is determined, and an alternating voltage is applied to the heater 55 for such determined electric power supply time.

With such controlling of the heating power of heater 55, roller surface temperature of the heat roller 52 can be adjusted to a given preferable temperature such as a given target temperature.

The pressure roller 61, used as a pressure member, may include a metal core 63 and an insulation elastic layer 62 formed on the metal core 63, wherein the insulation elastic layer 62 is formed on an adhesive layer formed on the metal core 63. The insulation elastic layer 62 may be made of insulation elastic material such as foamed silicone rubber or the like. The pressure roller 61 is pressed toward the heat roller 52 using the position adjusting members 66 and 67 as a first position adjusting unit.

Specifically, the first position adjusting unit may include the position adjusting members 66 and 67, wherein the position adjusting members 66 and 67 may be a pressure lever 66, and a cam 67, respectively. One end of the pressure lever 66 is pivot-ably supported on a sidewall of the pre-heating unit 50, and the other end of the pressure lever 66 is supported by the cam 67. A shaft 64 of the pressure roller 61 is placed on a center of the pressure lever 66. With such a configuration, the pressure roller 61 can be pushed to an upward direction (i.e., toward the heat roller 52) or downward direction, by which the first nip NP1 between the pressure roller 61 and the heat roller 52 can be set with a preferable space.

By disposing the above-described pre-heating unit 50, the transfer face of the recording medium P (e.g., sheet) can be selectively heated before the recording medium P is processed at the secondary transfer process, by which output image having higher glossiness can be produced. The transfer face of the recording medium P is a face that a toner image is transferred and adhered. Such heating process for the recording medium P before conducting the secondary transfer process may be termed of "pre-heating" or "pre-heating of recording medium."

Specifically, the transfer face of the recording medium P is pre-heated by the pre-heating unit 50 just before the secondary transfer process is conducted, and then a toner image is transferred to the pre-heated recording medium P at the transfer position.

Typically, the toner image is composed of a greater number of toner particles and is formed as a layer of such toner particles (hereinafter, toner layer) on the recording medium P. Accordingly, such toner layer has an upper face, which is a top portion of the toner layer, and a lower face, which is a bottom portion of the toner layer contacting the recording medium P. Hereinafter, the upper face may be referred as "upper toner face" and the lower face may be referred as "lower toner face."

When the recording medium P is pre-heated as above described, and then the secondary transfer process is conducted, the lower toner face may be set to a toner-soft condition due to heat energy applied by the preheating. Accordingly, when the recording medium P is transported to the fixing unit 20, the lower toner face may be maintained at such toner-soft condition. In the fixing unit 20, heat energy is mainly applied from the upper toner face. With such a configuration, heat energy can be distributed to the toner layer more evenly, by which output image having higher glossiness can be produced. Such heating configuration employed for the high gloss mode may preferably enhance glossiness of image fixed on the recording medium P.

In a conventional configuration, to enhance glossiness of image, greater amount of heat energy, which is greater than heat energy used for the normal mode, may be required for a fixing process to secure a good level of image fixability alone.

On one hand, in the above-described heating configuration, the recording medium P can be pre-heated before the secondary transfer process. Accordingly, the fixing process can be conducted to the pre-heated recording medium P by applying a given level of heat energy set for the fixing process, which may be equivalent to ordinary level of heat energy set for the fixing process, to secure a good level of image fixability during the high gloss mode. Accordingly, an image having higher glossiness level can be formed on the recording medium P without applying excessive heat energy. Such fixing process for the high gloss mode may be conducted as similar to a fixing process for the normal mode. Accordingly, hot-offset phenomenon, which may occur when greater heat energy is applied, can be prevented.

Further, in the first example embodiment, even when the high gloss mode is selected, in which the pre-heating unit 50 is used for pre-heating, the recording medium P passes through a transport route same as the normal mode, by which transport speed (or line velocity) of the recording medium P may not need to be changed during the high gloss mode. Accordingly, productivity of the output image for the high gloss mode can be set to a level similar to productivity of the output image for the normal mode. Accordingly, while maintaining productivity of the output image, hot-offset phenomenon at the upper toner face can be prevented, and glossiness of the output image can be enhanced.

Further, in the first example embodiment, the first position adjusting unit may be used as a first-nip width adjuster to change a nip width at the first nip NP1. Specifically, the cam 67 can be moved for a given rotation angle about its rotation shaft by a drive unit 74, by which the pressure lever 66 can rotate for a given angle about a rotation shaft of the pressure lever 66. With such a configuration, a pressure force applied to the heat roller 52 from the pressure roller 61 can be changed, by which a nip width at the first nip NP1 can be changed. Specifically, the position detectors 68*a* to 68*c* (e.g., photosensor) optically detect an edge position of the pressure lever 66, and then detection result of the position detectors 68*a* to 68*c* is transmitted to the control unit 43. With such a configuration, the control unit 43 can control a nip width at the first nip NP1, and thereby heating condition at the first nip NP1 can be changed. As such, the first-nip width adjuster may be used as a first heat controller, and the first-nip width adjuster may include the pressure lever 66 and the cam 67.

Further, in the first example embodiment, the first position adjusting unit may be used as a separation unit for separating the pressure roller 61 from the heat roller 52. Specifically, as shown in FIG. 5, when the cam 67 is moved for a given rotation angle by the drive unit 74, the pressure lever 66 rotates for a given angle about its rotation shaft, by which the pressure lever 66 can be moved to a given position where the pressure roller 61 is separated from the heat roller 52 completely.

The position detectors 68*a* to 68*c* can optically detects an edge position of the pressure lever 66, and then detection results of the position detectors 68*a* to 68*c* are transmitted to the control unit 43. With such a configuration, the control unit 43 can control a position of the pressure roller 61 with respect to the heat roller 52, and thereby heating condition at the first nip NP1 can be changed. As such, the separation unit may be used as a first heat controller, and the separation unit may include the pressure lever 66 and the cam 67. For example, the control unit 43 controls to move the pressure roller 61 to a position separated from the heat roller 52. The pressure roller 61 can be separated from the heat roller 52 when an operator selects the normal mode, for example.

Further, as shown in FIG. 4, a guide plate for guiding the recording medium P into a transport direction is disposed at an entry side and exit side of the first nip NP1 set by the heat roller 52 and the pressure roller 61. Specifically, the guide plate 75*a* is disposed at the entry side of the first nip NP1, and the guide plate 75*b* is disposed at the exit side of the first nip NP1 to guide a transportation of the recording medium P.

As shown in FIG. 5, the guide plates 75*a* and 75*b* can be moved between a first position (see dashed line in FIG. 5) to a second position (see solid line in FIG. 5) using a drive unit including a drive motor or the like. When the first position adjusting unit (see such as 66 and 67) separates the pressure roller 61 from the heat roller 52, the guide plates 75*a* and 75*b* can be moved to the second position so that the recording medium P does not contact the heat roller 52. The guide plates 75*a* and 75*b* may be integrated as a movable transport route, which can be moved as above described.

Specifically, when the normal mode is selected, the first position adjusting unit used as the separation unit can separate the pressure roller 61 from the heat roller 52, and then the movable transport route having the guide plates 75*a* and 75*b* can changes its position as shown in FIG. 5, in which the guide plates 75*a* and 75*b* is moved to a downward direction so that the recording medium P does not contact the heat roller 52. Further, when the normal mode is selected, only the pressure roller 61 is rotated, and the heat roller 52 may not be rotated by not transmitting a driving force to the heat roller 52.

Further, as shown in FIG. 4, the sheet position detectors 76*a* and 76*b* are respectively disposed at an entry side and exit side of the first nip NP1, set by the heat roller 52 and the pressure roller 61 in the pre-heating unit 50. The sheet position detectors 76*a* and 76*b*, used as the first and second recording medium detectors, detect the recording medium P. The sheet position detectors 76*a* and 76*b* may include a photosensor, and a filler, for example. When the recording medium P passes through the sheet position detectors 76*a* and 76*b*, the filler contactable to the recording medium P may vibrate, and then the sheet position detectors 76*a* and 76*b* (e.g., photosensor) optically detects such vibration of the filler.

Further, in the first example embodiment, the first temperature sensor 60 is disposed near an exit position of the pre-heating unit 50. The first temperature sensor 60, used as temperature detector, detects temperature of the recording medium P just passed through the pre-heating unit 50. Based on a detection result of the first temperature sensor 60, an amount of heat energy to be applied to the recording medium P per unit area by the pre-heating unit 50 can be changed and controlled.

If the pre-heated recording medium P is transported to the fixing unit 20 without detecting the temperature of recording medium P, an image having preferable level of glossiness may not be obtained. For example, even if the recording medium P is pre-heated, heat energy required for the fixing process may vary depending on types of sheets such as for example thickness variation.

On one hand, in the first example embodiment, the temperature of the recording medium P just passed through the pre-heating unit 50 is detected. Based on the detection result of the first temperature sensor 60, heat energy required for the fixing process can be determined and set, by which output images having enhanced glossiness can be produced reliably.

The amount of heat energy to be applied to the recording medium P per unit area by the pre-heating unit 50 can be changed by using any one of a first heat source controller, which changes heating power of the heater 55 (used as first heat source), and the first-nip width adjuster to change a nip width at the first nip NP1, or using both of the first heat source controller and the first-nip width adjuster. The first heat source controller will be described later.

Specifically, when the high gloss mode is selected, the first temperature sensor 60 detects temperature of the recording medium P just passed through the pre-heating unit 50. The detection result is transmitted to the control unit 43, and the control unit 43 controls the power source unit 72 to change heating power of the heater 55, in which heating power of the heater 55 is controlled using a given standard value set in advance. With such control, surface temperature of the heat roller 52 heated by the heater 55 can be adjusted, and then an amount of heat energy to be applied to the recording medium P per unit area can be set to a preferable level. Accordingly, the first heat source controller may include the control unit 43, the power source unit 72, and the first temperature sensor 60.

In the first example embodiment, a standard temperature A2 is set for the heat roller 52, and the temperature of the heat roller 52 is adjusted within a given range by setting the standard temperature A2 as a center value in the given range. For example, based on the temperature detected by the first temperature sensor 60, the temperature of the heat roller 52 is increased and decreased with a range of "A2±5° C." Further, with such a temperature control of the heat roller 52, a detection temperature of the first temperature sensor 60 may be constantly controlled to a given temperature Q.

Further, in the high gloss mode, when the first temperature sensor 60 detects temperature of the recording medium P just passed through the pre-heating unit 50, the detection result is transmitted to the control unit 43, and then the control unit 43 controls the drive unit 74 (and the cam 67) to change a position of the pressure lever 66 as required. With such control, a nip width at the first nip NP1 can be adjusted, and then an amount of heat energy to be applied to the recording medium P per unit area can be set to a preferable level.

In the first example embodiment, based on the temperature detected by the first temperature sensor 60, an edge position (or position of cam 67) is changed from a reference position detectable by the second position detector 68*b* to another positions detectable by one of the first position detector 68*a* and the third position detector 68*c*, by which a detection temperature of the first temperature sensor 60 can be constantly controlled to a given temperature Q.

Further, the amount of heat energy to be applied to the recording medium P per unit area by the pre-heating unit 50 can be changed by using the first heat source controller that can change heating power of the heater 55 (used as first heat source), or the first-nip width adjuster that can change a nip width at the first nip NP1. Further, the amount of heat energy to be applied to the recording medium P per unit area applied by the pre-heating unit 50 can be changed by using both of the first heat source controller and the first-nip width adjuster.

Figure 6:
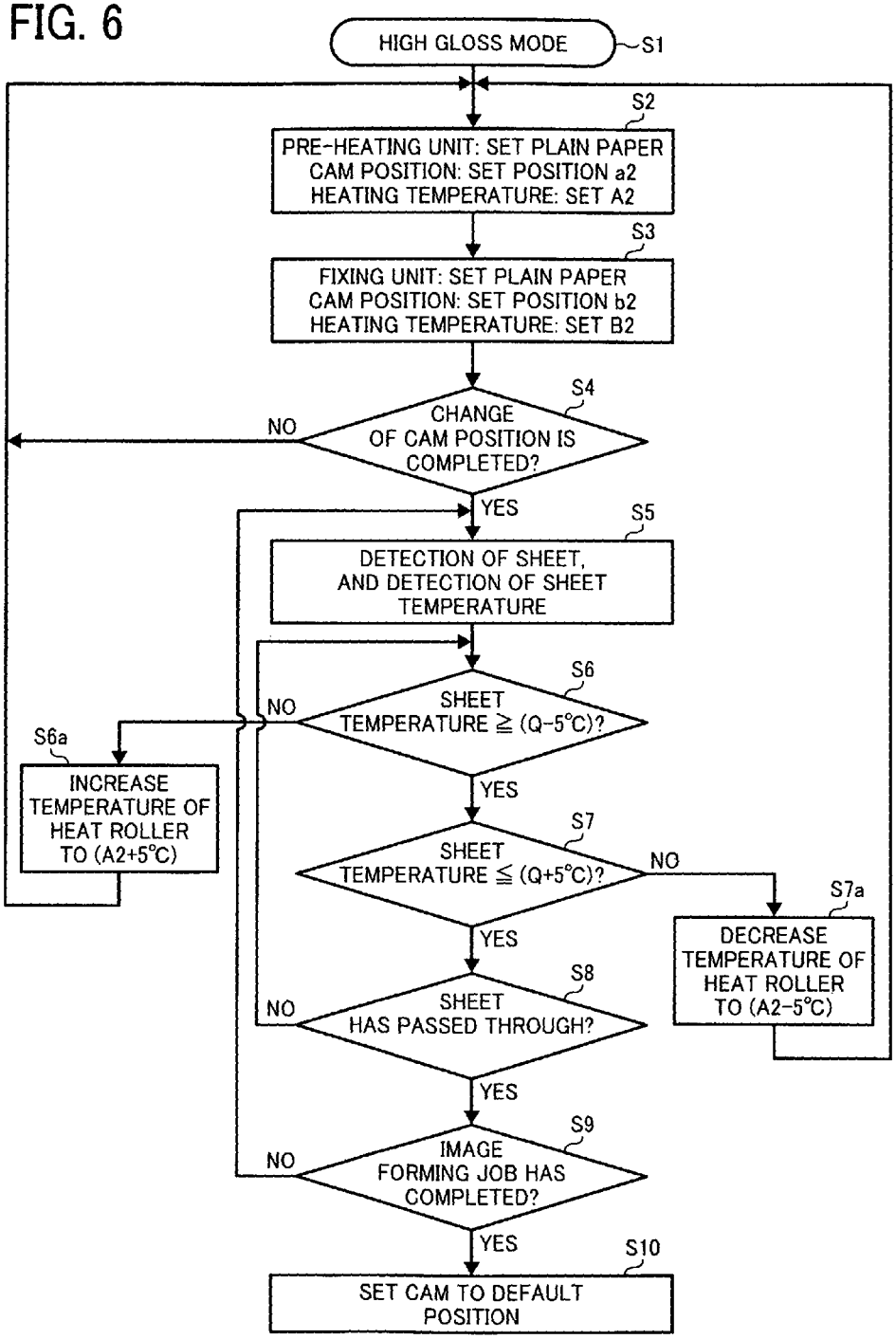
FIG. 6 is a control flow chart for the pre-heating unit.

FIG. 6 is a flow chart showing a control process for the pre-heating unit 50 when the high gloss mode is selected. As shown in FIG. 6, when the high gloss mode is selected (step S1), the pre-heating unit 50 is set to the high gloss mode configuration (see FIG. 4) from the normal mode configuration (see FIG. 5).

At step S2, a cam position of the pre-heating unit 50 is set to a standard position a2, and the heating temperature of the heat roller 52 is set to a standard value A2. The cam position a2 of the pre-heating unit 50 is a position of the pressure lever 66, detectable by the second position detector 68*b*, and the standard value A2 is controlled by heating power of the heater 55.

At step S3, the cam position of the-fixing unit 20 is set to a standard position b2, and the fixing temperature of the fixing belt 21 is set to a standard value B2. The cam position b2 of the fixing unit 20 is a position of the pressure lever 36 detectable by the second position detection sensor 38*b*, and the standard value B2 is controlled by heating power of the heater 25.

At step 4, it is determined whether the position change of cam position of pre-heating unit 50 (or movement of the pressure lever 66) has completed or not. If it is determined that the position change of cam position of pre-heating unit 50 is not completed, the process goes back to step S2.

If it is determined that the position change of cam position of pre-heating unit 50 is completed, the process goes to step S5.

At step S5, a timing that the recording medium P reaches the first temperature sensor 60 is detected by the sheet position detectors 76*a* and 76*b* (used as first and second recording medium detectors), and then the first temperature sensor 60 detects temperature of the recording medium P at such timing.

At step S6, it is determined whether the detected temperature result of the first temperature sensor 60 is equal to or greater than a temperature of "Q−5° C.", wherein Q is a given set temperature value.

If it is determined that a detected temperature result of the first temperature sensor 60 is less than "Q−5° C.," it is determined that the pre-heating energy is not sufficient, and the heating temperature of heat roller 52 is increased for a given temperature than the standard value A2 at step S6*a* (increasing to A2+5° C., for example). On one hand, if it is determined that the detected temperature result of the first temperature sensor 60 is equal to or greater than "Q−5° C.," the process goes to step S7.

At step S7, it is determined whether the detected temperature result of the first temperature sensor 60 is equal to or less than "Q+5° C."

If it is determined that the detected temperature result of the first temperature sensor 60 is greater than "Q+5° C.," it is determined that the pre-heating energy is excessive, and the heating temperature of the heat roller 52 is decreased for a given temperature than the standard value A2 at step S7*a* (decreasing to A2−5° C., for example).

On one hand, if it is determined that the detected temperature result of the first temperature sensor 60 is equal to or less than "Q+5° C.", it is determined that the pre-heating energy is sufficiently provided, and the process goes to step S8.

At step S8, it is determined whether the recording medium P has passed through a position of the first temperature sensor 60.

If it is determined that recording medium P has not yet passed through a position of the first temperature sensor 60, the process goes back to step S6. If it is determined that the recording medium P has passed through a position of the first temperature sensor 60, the process goes to step S9.

At step S9, it is determined whether an image forming job has completed. If it is determined that the image forming job has not yet completed, the process goes to step S5. On one hand, if it is determined that the image forming job has completed, the process goes to step S10, and then the cam position of the pre-heating unit 50 is returned to a default position (e.g., a position set for the normal mode), and the process ends at step S10.

Further, in the first example embodiment, when the high gloss mode is not selected (or when the normal mode is selected), the separation unit separates the pressure roller 61 from the heat roller 52, and the movable transport route having the guide plates 75*a* and 75*b* is moved to change a transport route of the recording medium P, by which the recording medium P is not contacted to the heat roller 52. While separating the pressure roller 61 from the heat roller 52, the pressure roller 61 is rotatable by a drive motor. Accordingly, the recording medium P can be transported by the pressure roller 61 without contacting the heat roller 52. With such a configuration, during the normal mode, the recording medium P may not receive heat energy from the heat roller 52, by which the temperature of the recording medium P at the transfer position can be maintained at ordinary temperature level. The ordinary temperature may mean temperature when an image forming apparatus is not provided with the pre-heating unit 50. Accordingly, an image having preferable image quality can be reliably produced for the normal mode because the transfer position may not be supplied with excessive heat energy.

Further, in the first example embodiment, based on a detection result of the sheet position detectors 76*a* and 76*b* (used as first and second recording medium detectors), a timing that the first temperature sensor 60 detects temperature of the recording medium P is determined. With such a configuration, the first temperature sensor 60 may not detect temperature when the recording medium P does not exist at a detection position of the first temperature sensor 60. Typically, because a number of sheets (i.e., recording medium P) may be fed sporadically, the recording medium P does not exist at the detection position at some time. Further, even if the first temperature sensor 60 may detect temperature when the recording medium P does not exist at a detection position of the first temperature sensor 60, such false data can be deleted afterward.

Further, when a double-face printing operation is conducted, the recording medium P passes through the pre-heating unit 50 for two times. If the pre-heating unit 50 heats a first face (or front face) of the recording medium P, and then heats a second face (or back face) of the recording medium P, the recording medium P may be heated too much, and thereby image quality may degrade. Accordingly, the pre-heating unit 50 can be controlled to heat only the first face of the recording medium P when the double-face printing operation is conducted, by which high gross image can be produced effectively and reliably.

Further, in the image forming apparatus 1, based on the detected temperature result of the first temperature sensor 60, an amount of heat energy to be applied to the recording medium P per unit area by the second heat controller, disposed in the fixing unit 20, can be changed. The second heat controller includes a second heat source controller and the second-nip width adjuster. The second heat source controller may include the control unit 43, the power source 42, and the first temperature sensor 60 (used as a sheet temperature sensor), and the second heat source controller can change heating power of the heater 25 (used as a second heat source). The second-nip width adjuster can change a nip width at the second nip.

Specifically, with reference to FIG. 3, an image forming operation for the high gloss mode is described. When the first temperature sensor 60 detects the temperature of the recording medium P just passed through the pre-heating unit 50, the detection result is transmitted to the control unit 43. Then, the control unit 43 controls the power source 42 to change heating power of the heater 25 from a given standard value set in advance, as required. With such a configuration, even if the amount of pre-heating energy may vary for some level due to a change of pre-heating condition of the pre-heating unit 50, the heating power of the heater 25 can be adjusted to a given level that can produce image having uniform glossiness.

For example, in the first example embodiment, when the first temperature sensor 60 detects temperature, which is fluctuating (i.e., increased or decreased) from a given standard value set in advance, the standard temperature B2 of the fixing belt 21 can be increased and decreased within a range of ±5 Celcius degrees (i.e., B2±5° C.) to adjust insufficiency or excessiveness of heat energy, by which image having preferable glossiness can be produced. Such process is to be described later with reference to FIG. 7.

Further, in the high gloss mode, when the first temperature sensor 60 detects temperature of the recording medium P just passed through the pre-heating unit 50, the detection result is transmitted to the control unit 43. Then, the control unit 43 controls the drive unit 44 to change a position of the cam 37 and the pressure lever 36, as required. With such a configuration, even if the amount of pre-heating energy may vary for some level due to a change of pre-heating condition of the pre-heating unit 50, the amount of pre-heating energy can be adjusted to a given level that can produce image having uniform glossiness. In the first example embodiment, when the first temperature sensor 60 detects temperature, which is fluctuating (i.e., increased or decreased) from a given standard value set in advance, the edge position of the pressure lever 36 (or position of the cam 37) can be shifted from a standard position detectable by the second position detection sensor 38*b* to a position detectable by the first position detection sensor 38*a* or the third position detection sensor 38*c*. Such positional change of the pressure lever 36 may mean a relative position change between the fixing belt 21 and the pressure roller 31 at the second nip. With such positional change, insufficiency or excessiveness of heat energy can be adjusted, by which image having preferable glossiness can be produced.

As such, even if the temperature of the pre-heated recording medium P may vary for some level, such temperature fluctuation can be adjusted by adjusting heat energy supplied by the fixing unit 20, by which image having preferable glossiness can be produced.

Further, in the first example embodiment, the second heat controller disposed for the fixing unit 20 may include the second heat source controller that can change heating power of the heater 25 (used as second heat source), and the second-nip width adjuster that can change a nip width at the second nip. The second heat source controller and the second-nip width adjuster may be used alone or in combination to adjust heat energy supplied by the fixing unit 20.

Figure 7:
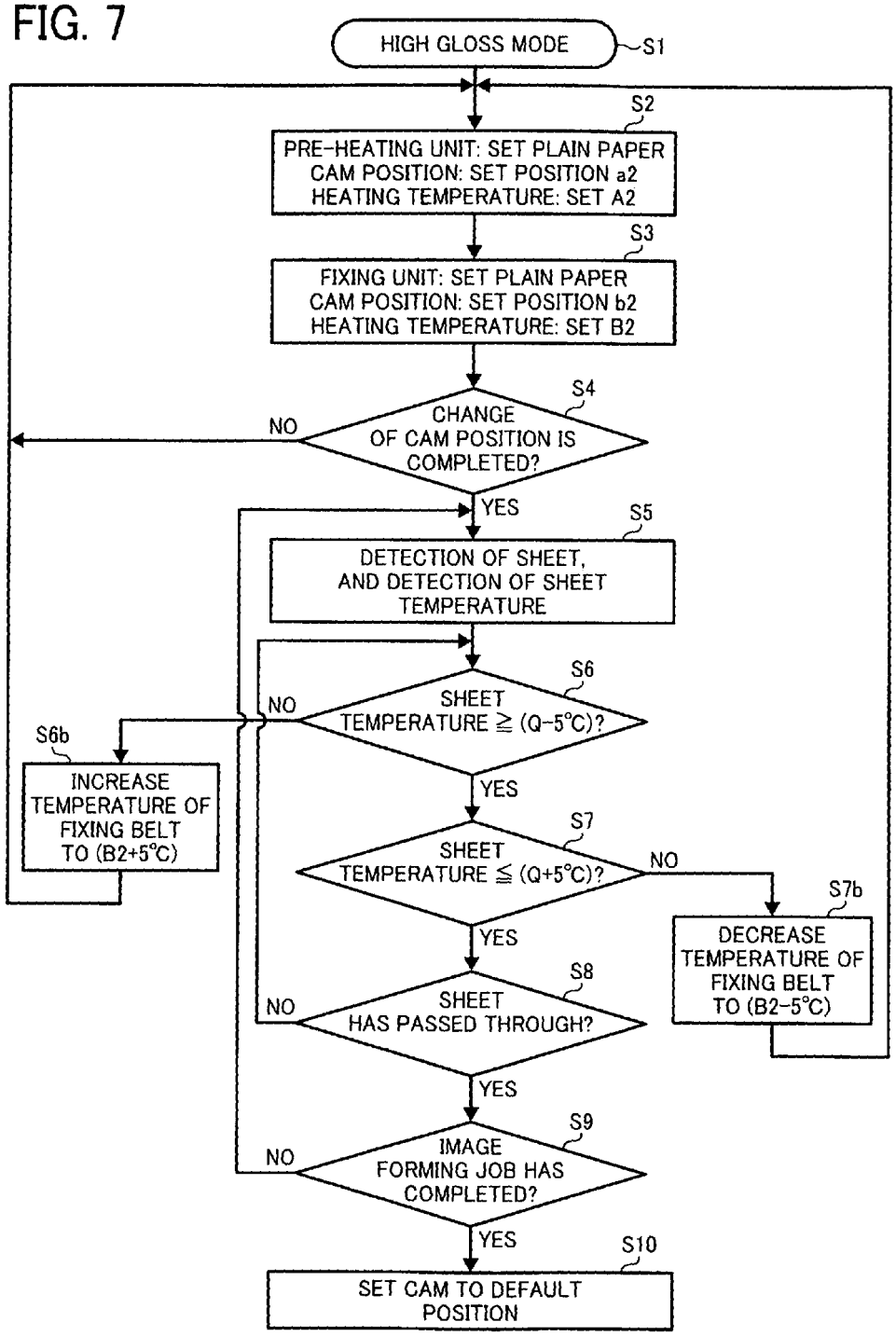
FIG. 7 is a control flow chart for the fixing unit.
Figure 8A:
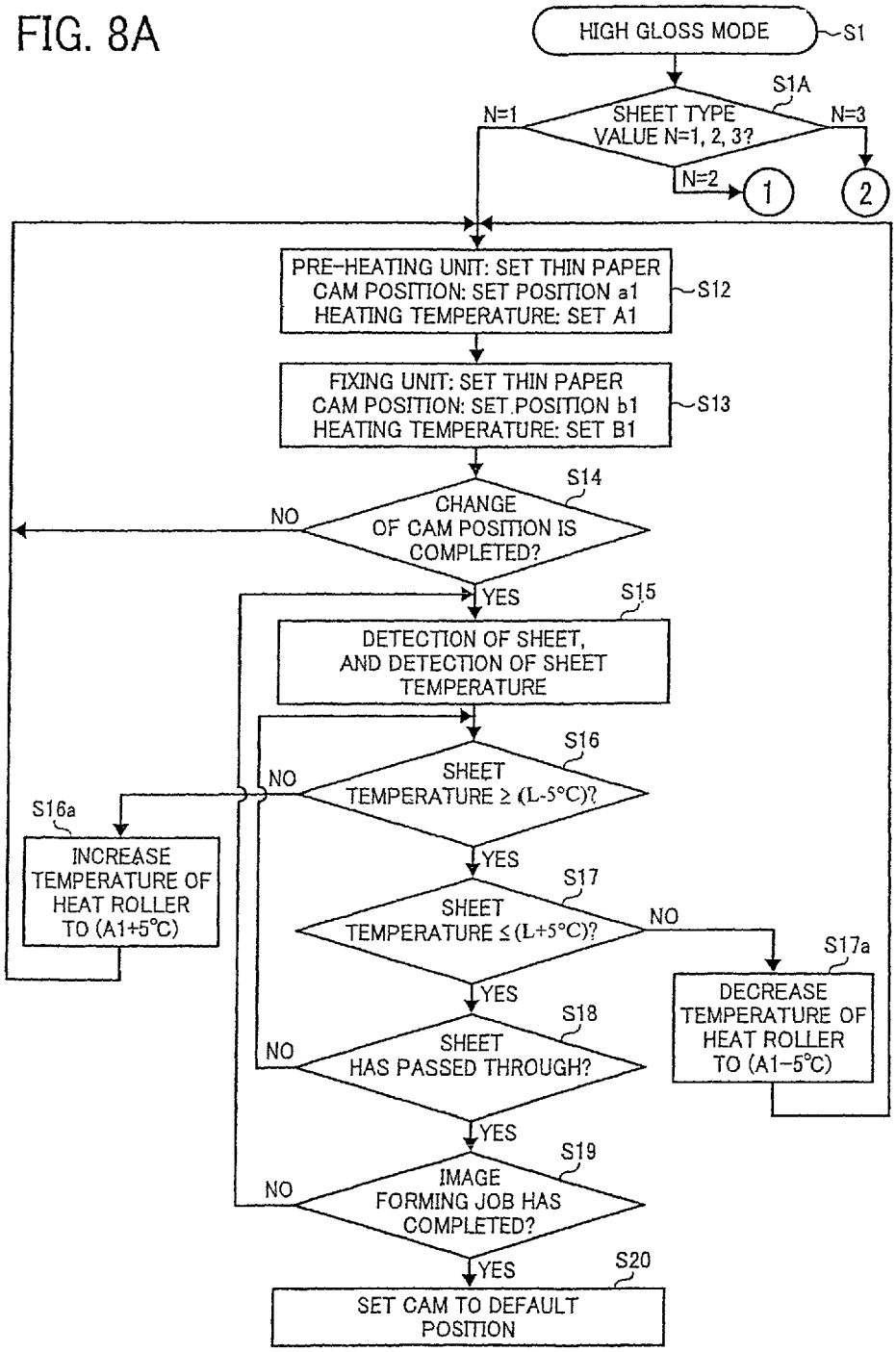
FIGS. 8A to 8E show a control flow chart for an image forming apparatus according to a second example embodiment.
Figure 8B:
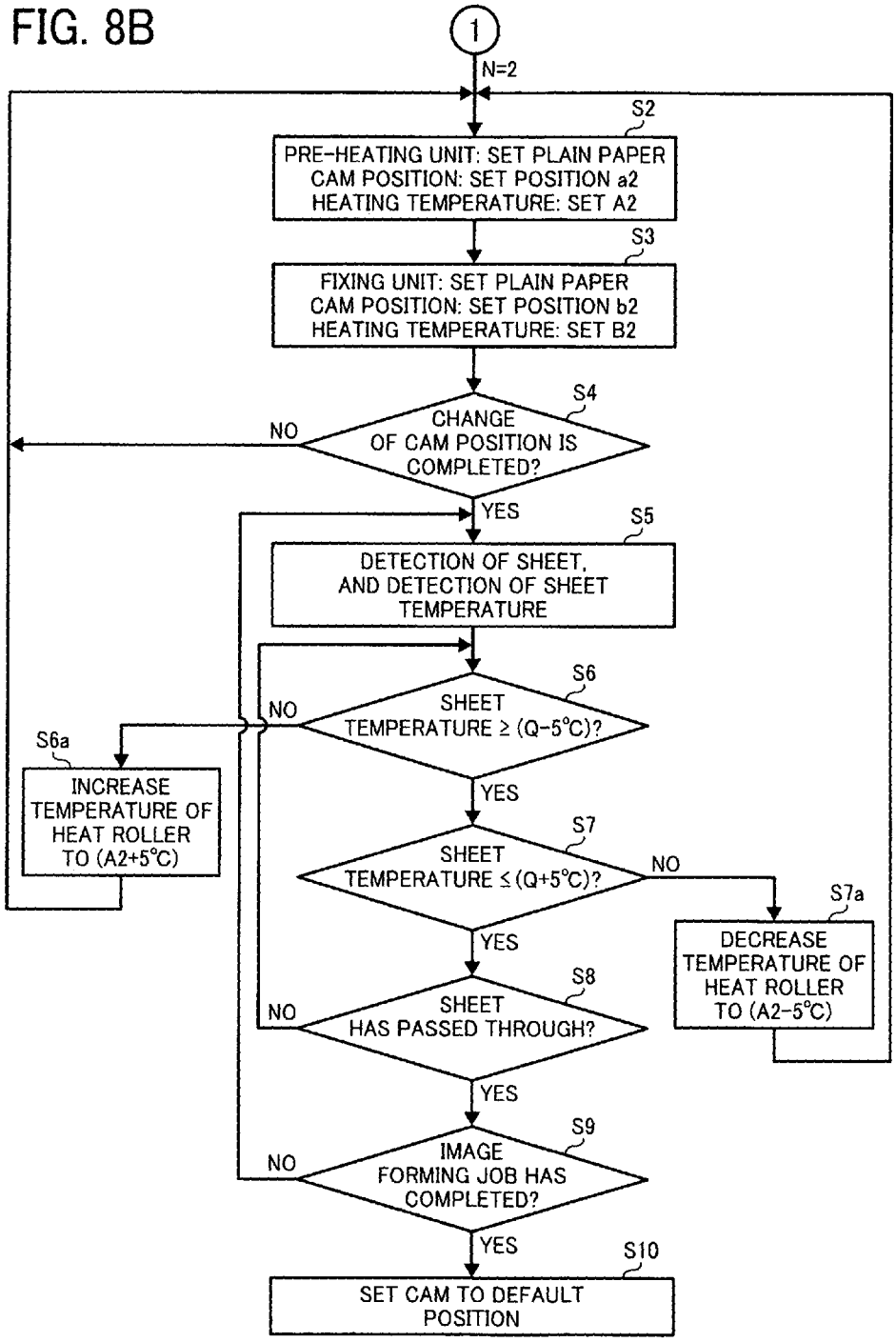
Figure 8C:
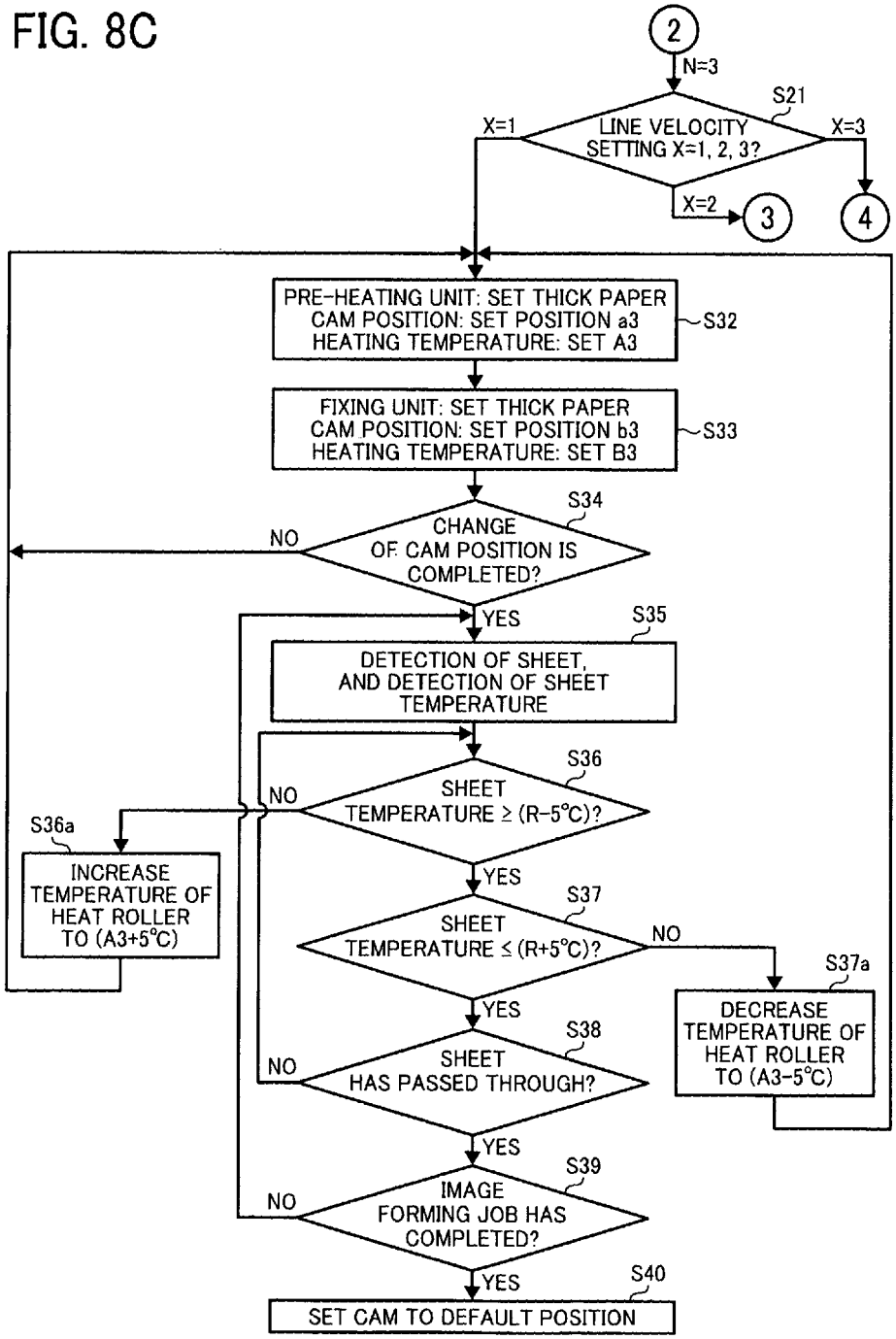
Figure 8D:
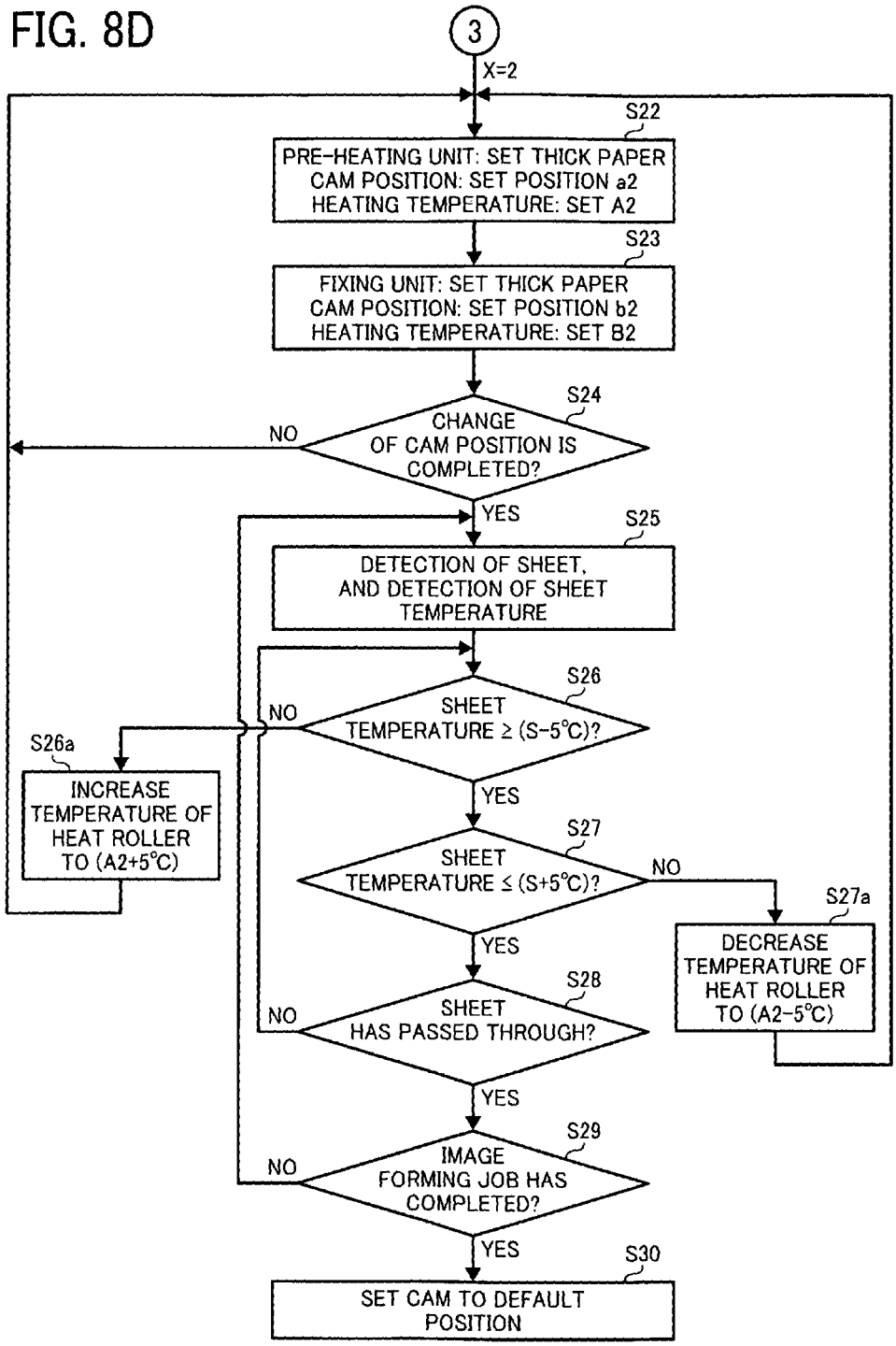
Figure 8E:
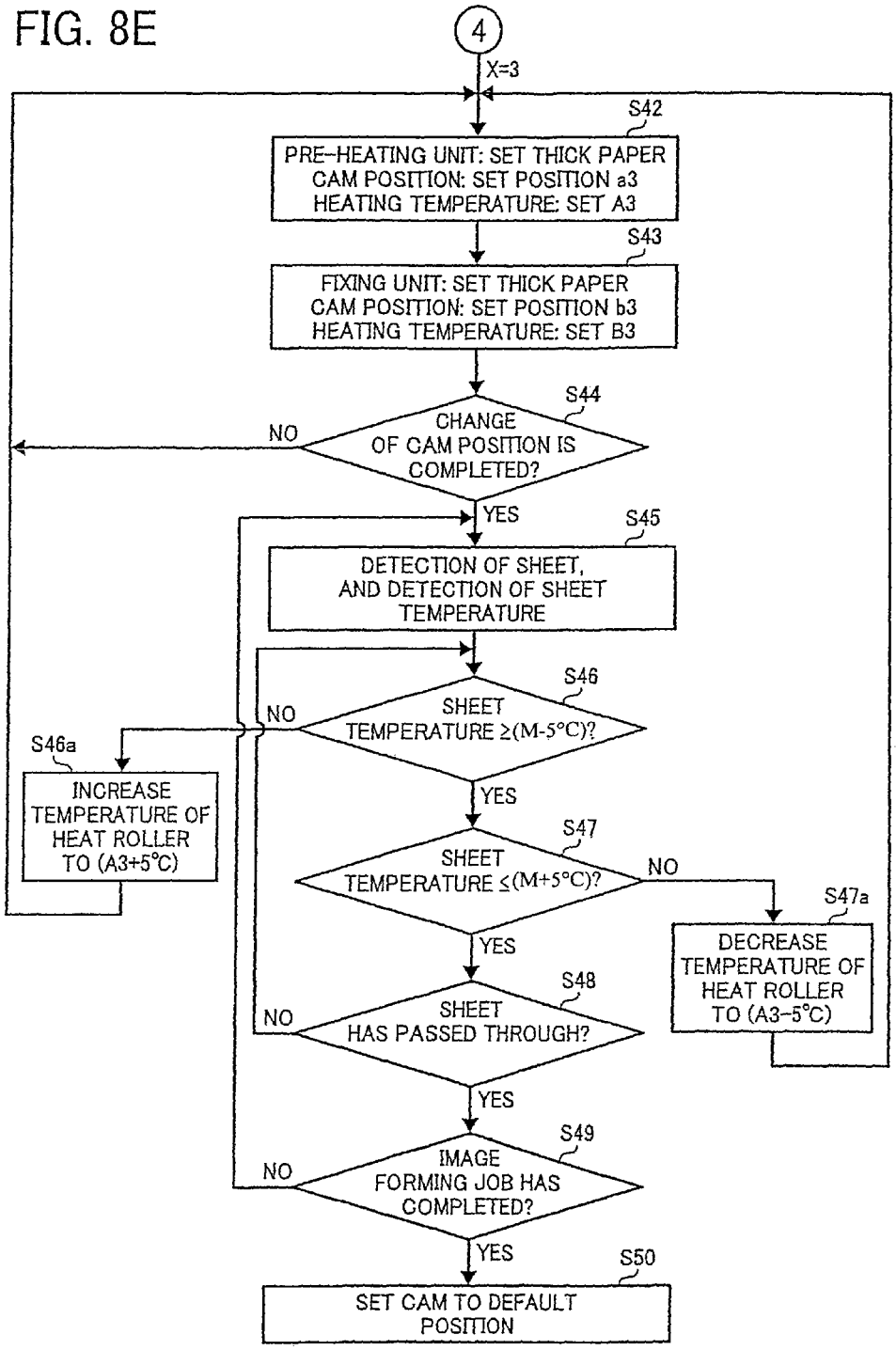

FIG. 7 is a flow chart showing a control process for the fixing unit 20 when the high gloss mode is selected. As shown in FIG. 7, when the high gloss mode is selected (step S1), the pre-heating unit 50 is set to the high gloss mode configuration (see FIG. 4) from the normal mode configuration (see FIG. 5).

At step S2, a cam position of the pre-heating unit 50 is set to a standard position a2, and the heating temperature of the heat roller 52 is set to a standard value A2. The cam position a2 of the pre-heating unit 50 is a position of the pressure lever 66, detectable by the second position detector 68*b*, and the standard value A2 is controlled by heating power of the heater 55.

At step S3, the cam position of the fixing unit 20 is set to a standard position b2, and the fixing temperature of the fixing belt 21 is set to a standard value B2. The cam position b2 of the fixing unit 20 is a position of the pressure lever 36 detectable by the second position detection sensor 38*b*, and the standard value B2 is controlled by heating power of the heater 25.

At step 4, it is determined whether the position change of cam position of pre-heating unit 50 (or movement of the pressure lever 66) has completed or not. If it is determined that the position change of cam position of pre-heating unit 50 is not completed, the process goes back to step S2.

If it is determined that the position change of cam position of pre-heating unit 50 is completed, the process goes to step S5.

At step S5, a timing that the recording medium P reaches the first temperature sensor 60 is detected by the sheet position detectors 76*a* and 76*b* (used as first and second recording medium detectors), and then the first temperature sensor 60 detects temperature of the recording medium P at such timing.

At step S6, it is determined whether the detected temperature result of the first temperature sensor 60 is equal to or greater than a temperature of "Q−5° C.", wherein Q is a given set temperature value.

If it is determined that a detected temperature result of the first temperature sensor 60 is less than "Q−5° C.," it is determined that the pre-heating energy is not sufficient, and the surface temperature of the fixing belt 21 is increased for a given temperature than the standard value B2 at step S6*b* (increasing to B2+5° C., for example).

On one hand, if it is determined that the detected temperature result of the first temperature sensor 60 is equal to or greater than "Q−5° C.," the process goes to step S7.

At step S7, it is determined whether the detected temperature result of the first temperature sensor 60 is equal to or less than "Q+5° C."

If it is determined that the detected temperature result of the first temperature sensor 60 is greater than "Q+5° C.," it is determined that the pre-heating energy is excessive, and the surface temperature of the fixing belt 21 is decreased for a given temperature than the standard value B2 at step S7*b* (decreasing to B2−5° C., for example) Steps S8 and S9 in FIG. 7 are similar to Steps S8 and S9 in the flowchart of FIG. 6.

Further, the image forming apparatus 1 may include a second temperature sensor 85 as shown in FIG. 2. The second temperature sensor 85 is disposed at a position facing an outer face of the intermediate transfer belt 17 in a non-contact manner, and between the secondary transfer counter roller 19A and the tension roller 19C. The second temperature sensor 85 detects temperature of the intermediate transfer belt 17. Further, the image forming apparatus 1 may include a cooling fan 86 as shown in FIG. 2. The cooling fan 86 is disposed at a position facing an outer face of the intermediate transfer belt 17 and downstream side of the tension roller 19C. The cooling fan 86 can cool the intermediate transfer belt 17.

When the second temperature sensor 85 detects that temperature of the intermediate transfer belt 17 reaches a given value, the cooling fan 86 cools the intermediate transfer belt 17. During the high gloss mode, the pre-heated recording medium P may contact the intermediate transfer belt 17 at the transfer position (transfer nip). Accordingly, if a continuous printing operation is conducted, or the temperature of the pre-heating unit 50 is set to a higher temperature, the surface temperature of the intermediate transfer belt 17 may become too high. Accordingly, if the second temperature sensor 85 detects that the temperature of the intermediate transfer belt 17 exceeds the given temperature value, the cooling fan 86 is activated to cool the intermediate transfer belt 17. With such a configuration, sudden temperature increase of the intermediate transfer belt 17 can be prevented even if the pre-heated recording medium P passes through the transfer position, and thereby the intermediate transfer belt 17 and other parts or devices facing the intermediate transfer belt 17 may not be exposed to an excessive heat effect, by which heat effect to the intermediate transfer belt 17 and other parts can be suppressed. Further, because the cooling fan 86 is disposed over the fixing unit 20 and the transport belt 80, and can flow cooling air to an upward direction, the fixing unit 20 and the transport belt 80 may not receive such cooling air.

Further, in the first example embodiment, the secondary transfer counter roller 19A may include an insulation elastic layer 19A1 (see FIG. 2) made of foamed silicone rubber or the like to prevent accumulation of heat energy in the secondary transfer counter roller 19A, by which temperature increase of the intermediate transfer belt 17 can be suppressed. If the secondary transfer counter roller 19A has an elastic layer made of solid rubber, heat energy of the pre-heated recording medium P may accumulate in the secondary transfer counter roller 19A, by which temperature of the intermediate transfer belt 17 may be increased too high.

Further, as above described, the pressure roller 61 in the pre-heating unit 50 includes the insulation elastic layer 62 made of insulation elastic material 62 such as foamed silicone rubber or the like. With such a configuration, heat energy may not accumulate in the pressure roller 61 even if the pressure roller 61 contacts the heat roller 52 during the high gloss mode. Because heat energy may not accumulate in the pressure roller 61 during the high gloss mode as such, the recording medium P may not be heated by the pressure roller 61 during the normal mode even if the recording medium P contacts the pressure roller 61 when the mode is changed to the normal mode from the high gloss mode. As such, heat energy effect when the mode is changed from the high gloss mode to the normal mode can be prevented.

As above described, in the first example embodiment, the pre-heating unit 50 is disposed with the fixing unit 20. The pre-heating unit 50 can selectively heat the recording medium P before the recording medium P is transported to the transfer position, and the fixing unit 20 fixes the toner image T on the recording medium P, transferred at the transfer position. Temperature of the recording medium P passed through the pre-heating unit 50 is detected, and based on a detection result of temperature of the recording medium P, an amount of heat energy to be applied to the recording medium P per unit area by the pre-heating unit 50 is changed. With such a configuration, without decreasing productivity of the output image, hot-offset phenomenon can be prevented, and glossiness of the output image can be enhanced reliably.

Although the fixing belt 21 is used as a fixing member, and the pressure roller 31 is used as a pressure member in the first example embodiment, the fixing member may include a fixing roller, and the pressure member may include a pressure belt, a pressure pad, or the like, and these alternatives may have a similar effect described in the first example-embodiment. Further, although the heat roller 52 is used as a heating member, and the pressure roller 61 is used as a pressure member in the first example embodiment, the heating member may include a heating belt, and the pressure member may include a pressure belt, and these alternatives may have a similar effect described in the first example embodiment.

A description is now given to a second example embodiment with reference to FIGS. 8A to 8E. FIGS. 8A to 8E show a flow chart for a control process for the second example embodiment. Different from the first example embodiment, in the second example embodiment, a control process for image forming operation may be conducted in view of types of the recording medium P, which may have different sheet thickness, for example.

As for the second example embodiment, the image forming apparatus may include a media type identifier to detect types of recording medium P. For example, the media type identifier may be a sheet thickness sensor 70, disposed at an upstream side of transport route of the recording medium P to detect sheet thickness of the recording medium P, and the sheet thickness sensor 70 may be disposed at an exit of the sheet feed unit 7 as shown in FIG. 1.

Further, in the second example embodiment, the image forming apparatus may include a transport speed controller to change transport speed (or process line velocity) of the recording medium P. The transport speed controller may include a drive motor to drive given devices used for an image forming (e.g., photoconductor) and a drive motor to drive rollers that drives a given transport member (e.g., a belt) used for transporting the recording medium P, for example. Specifically, the transport speed controller may change a transport speed (or process line velocity) of the recording medium P by changing a driving speed of a drive motor that drives the image forming devices (e.g., photoconductor), and/or by changing a driving speed of the drive motor that drives the transport member transporting the recording medium P, for example.

Based on detection result of the sheet thickness sensor 70, at least one of the first heat source controller, the first nip width adjuster in the pre-heating unit 50 and the transport speed controller may be controlled, as required.

In the second exemplary embodiment, the recording medium P may include sheets having various types of sheet thickness. To maintain a good level of image fixability on the recording medium P, fixing condition in the fixing unit 20 may need to be changed or adjusted depending on types of sheets. Such fixing condition adjustment may need to be conducted for the normal mode. For example, the fixing temperature may be changed, and the transport speed of the recording medium P may be set slower to increase a nip time at the second nip in the fixing unit 20.

Such fixing condition adjustment may also need to be conducted for the high gloss mode to maintain a good level of glossiness for the recording medium P having various types of sheet thickness. For example, a fixing temperature for the high gloss mode may be adjusted to a given level in view of heat resistance limit of specific parts used for the fixing process. For example, if the heat resistance limit of specific parts may be lower than a theoretically desirable fixing temperature to reliably fix images on a sheet, such desirable fixing temperature cannot be used, and thereby a lower fixing temperature may be used, by which the transport speed (or process line velocity) of the recording medium P may be adjusted to a slower speed so that an image having a good level of glossiness can be produced. Accordingly, when the high gloss mode is selected, based on detection result of the sheet thickness sensor, at least one of the first heat source controller, the first nip width adjuster in the pre-heating unit 50, and the transport speed controller may be controlled. With such a configuration, even when various types of recording medium P are used, image having higher glossiness can be produced reliably.

FIGS. 8A to 8E show a flow chart for a control process of the high gloss mode for the second example embodiment. As shown in FIGS. 8A to 8E, when the high gloss mode is selected (step S1), the sheet thickness sensor 70 detects sheet thickness of the recording medium P, and based on the detection result, it is determined whether sheet type value N is any one of 1 to 3 at step S1A. For example, the sheet type value N=1 is set for the recording medium P of thin sheet having a thinner thickness; the sheet type value N=2 is set for the recording medium P of plain sheet having a normal thickness; the sheet type value N=3 is set for the recording medium P of thick sheet having thicker thickness.

Accordingly, when it is determined that the sheet type value N is 2 (N=2, plain sheet), steps S2 to S10 shown in FIG. 6 may be conducted as similar to the first example embodiment.

If it is determined that the sheet type value N is 1 (N=1, thin sheet) at step S1A, the process goes to step S12.

At step S12, the cam position of the pre-heating unit 50 is set to a position a1, detectable by the third position detector 68*c*, and a heating temperature of the heat roller 52 is set to A1, which is less than the standard value A2 (A1<A2).

At step S13, the cam position of the fixing unit 20 is set to a position b1, detectable by the third position detection sensor 38*c*, and a fixing temperature of the fixing belt 21 is set to B1, which is less than the standard value B2 (B1<B2).

At step 14, it is determined whether the position change of cam position of pre-heating unit 50 (or movement of the pressure lever 66) has completed or not. If it is determined that the position change of cam position of pre-heating unit 50 is not completed, the process goes back to step S12.

On one hand, if it is determined that the position change of cam position of pre-heating unit 50 is completed, the process goes to step S15.

At step S15, a timing that the recording medium P reaches the first temperature sensor 60 is detected by the sheet position detectors 76*a* and 76*b* (used as first and second recording medium detectors), and then the first temperature sensor 60 detects temperature of the recording medium P at such timing.

At step S16, it is determined whether the detected temperature result of the first temperature sensor 60 is equal to or greater than a temperature of "L−5° C.", wherein L is a given set temperature value.

If it is determined that a detected temperature result of the first temperature sensor 60 is less than "L−5° C. ", it is determined that the pre-heating energy is not sufficient, and the heating temperature of heat roller 52 is increased for a given temperature than the temperature A1 at step 16*a* (increasing to A1+5° C., for example).

On one hand, if it is determined that the detected temperature result of the first temperature sensor 60 is equal to or greater than "L−5° C. ", the process goes to step S17.

At step S17, it is determined whether the detected temperature result of the first temperature sensor 60 is equal to or less than "L+5° C.".

If it is determined that the detected temperature result of the first temperature sensor 60 is greater than "L+5° C. ", it is determined that the pre-heating energy is excessive, and the heating temperature of the heat roller 52 is decreased for a given temperature than the temperature A1 at step 17*a* (decreasing to A1−5° C., for example).

The process after step S18 are similar to the process after step S8 of FIG. 6.

Further, if it is determined that the sheet type value N is 3 (N=3, thick sheet) at step S1A, the process goes to step S21.

At step S21, it is determined whether a transport speed X (or line velocity setting X) of the recording medium P is set to any one of 1 to 3, which are different speeds. For example, the transport speed X=1 is the faster speed, the transport speed X=2 is the middle speed, and the transport speed X=3 is the slower speed. Because of such different speeds, heat energy level required for image forming operation may be set to different levels for the different speeds. Accordingly, a given temperature value set as a reference value for the recording medium P may vary depending on transport speed X. For example, a given temperature value R is set for the transport speed X=1, a given temperature value S is set for the transport speed X=2, and a given temperature value M is set for the transport speed X=3. Because the transport speed X=1 is set as the faster speed, and the transport speed X=3 is set as the slower speed, the temperature value R is set to a greater value (i.e., greatest among R, S, M), the given temperature value S is set less than the temperature value R, and the given temperature value M is set less than the temperature value S (i.e., smallest among R, S, M). Accordingly, heat energy to be applied to a toner image per unit time becomes a greater level for transport speed X=1, heat energy to be applied to a toner image per unit time becomes a middle level for transport speed X=2, and heat energy to be applied to a toner image per unit time becomes a smaller level for transport speed X=3, for example.

If it is determined that the transport speed X is 2 (transport speed X=2) at step S21, steps S22 to S30 may be conducted as similar to step S2 to step S10 shown in FIG. 6 in the first example embodiment. However, a given temperature value S used as a reference value used at steps S26 and step S27 is different from the given temperature value Q in FIG. 6 because of difference of sheet types.

Further, if it is determined that the transport speed X is 1 (transport speed X=1) at step S21, the process goes to step S32.

At step S32, the cam position of the pre-heating unit 50 is set to a position a3, detectable by the first position detector 68*a*, and the heating temperature of the heat roller 52 is set to A3, which is greater than the standard value A2 (A3>A2).

At step S33, the cam position of the fixing unit 20 is set to a position b3, detectable by the first position detection sensor 38*a*, and the fixing temperature of the fixing belt 21 is set to B3, which is greater than the standard value B2 (B3>B2).

At step 34, it is determined whether the position change of cam position of pre-heating unit 50 (or movement of the pressure lever 66) has completed or not. If it is determined that the position change of cam position of pre-heating unit 50 is not completed, the process goes back to step S32.

On one hand, if it is determined that the position change of cam position of pre-heating unit 50 is completed, the process goes to step S35.

At step S35, a timing that the recording medium P reaches the first temperature sensor 60 is detected by the sheet position detectors 76*a* and 76*b* (used as first and second recording medium detectors), and then the first temperature sensor 60 detects temperature of the recording medium P at such timing.

At step S36, it is determined whether the detected temperature result of the first temperature sensor 60 is equal to or greater than a temperature of "R−5° C.", wherein R is a given set temperature value.

If it is determined that a detected temperature result of the first temperature sensor 60 is less than "R−5° C.," it is determined that the pre-heating energy is not sufficient, and the heating temperature of heat roller 52 is increased for a given temperature than the temperature A3 at step S36*a* (increasing to A3+5° C., for example).

On one hand, if it is determined that the detected temperature result of the first temperature sensor 60 is equal to or greater than "R−5° C.," the process goes to step S37.

At step S37, it is determined whether the detected temperature result of the first temperature sensor 60 is equal to or less than "R+5° C."

If it is determined that the detected temperature result of the first temperature sensor 60 is greater than "R+5° C.," it is determined that the pre-heating energy is excessive, and the heating temperature of the heat roller 52 is decreased for a given temperature than the temperature A3 at step S37*a* (decreasing to A3−5° C., for example).

The process after step S38 are similar to the process after step S8 of FIG. 6.

Further, if it is determined that the transport speed X is 3 (transport speed X=3) at step S21, the process goes to step S42.

At step S42, the cam position of the pre-heating unit 50 is set to a position a3, detectable by the first position detector 68*a*, and the heating temperature of the heat roller 52 is set to A3, which is greater than the standard value A2 (A3>A2).

At step S43, the cam position of the fixing unit 20 is set to a position b3, detectable by the first position detection sensor 38*a*, and the fixing temperature of the fixing belt 21 is set to B3, which is greater than the standard value B2 (B3>B2).

At step 44, it is determined whether the position change of cam position of pre-heating unit 50 (or movement of the pressure lever 66) has completed or not. If it is determined that the position change of cam position of pre-heating unit 50 is not completed, the process goes back to step S42.

On one hand, if it is determined that the position change of cam position of pre-heating unit 50 is completed, the process goes to step S45.

At step S45, a timing that the recording medium P reaches the first temperature sensor 60 is detected by the sheet position detectors 76*a* and 76*b* (used as first and second recording medium detectors), and then the first temperature sensor 60 detects temperature of the recording medium P at such timing.

At step S46, it is determined whether the detected temperature result of the first temperature sensor 60 is equal to or greater than a temperature of "M−5° C.", wherein M is a given set temperature value.

If it is determined that a detected temperature result of the first temperature sensor 60 is less than "M−5° C.", it is determined that the pre-heating energy is not sufficient, and the heating temperature of heat roller 52 is increased for a given temperature than the temperature A3 at step S46*a* (increasing to A3+5° C., for example).

On one hand, if it is determined that the detected temperature result of the first temperature sensor 60 is equal to or greater than "M−5° C.", the process goes to step 47.

At step S47, it is determined whether the detected temperature result of the first temperature sensor 60 is equal to or less than "M+5° C.".

If it is determined that the detected temperature result of the first temperature sensor 60 is greater than "M+5° C.", it is determined that the pre-heating energy is excessive, and the heating temperature of the heat roller 52 is decreased for a given temperature than the temperature A3 at step S47*a* (decreasing to A3−5° C., for example).

The process after step S48 are similar to the process after step S8 of FIG. 6.

As above described, as similar to the first example embodiment, in the second example embodiment, the pre-heating unit 50 is disposed with the fixing unit 20. The pre-heating unit 50 can selectively heat the recording medium P before the recording medium P is transported to the transfer position, and the fixing unit 20 fixes the toner image T on the recording medium P, transferred at the transfer position. Temperature of the recording medium P passed through the pre-heating unit 50 is detected, and based on a detection result of temperature of the recording medium P, an amount of heat energy to be applied to the recording medium P per unit area by the pre-heating unit 50 is changed. With such a configuration, without decreasing productivity of the output image, hot-offset phenomenon can be prevented, and glossiness of the output image can be enhanced reliably.

Further, in the image forming apparatus according to the above described example embodiments, a toner image carried on the intermediate transfer belt 17 (used as image carrying member) is transferred onto the recording medium P at the transfer position (transfer nip).

However, another configuration can be employed for such image transfer process. For example, a toner image carried on a photoconductor drum (used as image carrying member) can be transferred onto the recording medium P at a transfer position (or transfer nip). Even in such configuration, the pre-heating unit 50 can be disposed with the fixing unit 20. The pre-heating unit 50 heats the recording medium P before the recording medium P is transported to the transfer position, and the fixing unit 20 fixes the toner image T on the recording medium P, transferred at the transfer position. Temperature of the recording medium P passed through the pre-heating unit 50 is detected, and based on a detection result of temperature of the recording medium P, an amount of heat energy to be applied to the recording medium P per unit area by the pre-heating unit 50 can be changed. With such a configuration, without decreasing productivity of the output image, hot-offset phenomenon can be prevented, and glossiness of the output image can be enhanced reliably.

As above described, the image forming apparatus according to exemplary embodiments includes a pre-heating unit and a fixing unit, in which the pre-heating unit heats a recording medium before the recording medium is transported to a transfer position, at which a toner image is transferred on the recording medium. Then, the fixing unit fixes the toner image on the recording medium. In such image forming apparatus, temperature of the recording medium just passed through the pre-heating unit is detected, and based on a detection result of temperature of the recording medium, an amount of heat energy to be applied to the recording medium per unit area by the pre-heating unit is changed. Such image forming apparatus can reliably output images having enhanced glossiness without decreasing productivity of the output image and hot-offset phenomenon.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. An image forming apparatus, comprising:

an image carrying member to carry a toner image thereon;

a transfer unit to transfer the toner image carried on the image carrying member to a recording medium transported to a transfer position;

a pre-heating unit to selectively heat the recording medium before the recording medium is transported to the transfer position, the pre-heating unit including a heating member, a pressure member, a first heat source for heating the heating member;

a fixing unit to fix the toner image, transferred to the recording medium at the transfer position, on the recording medium;

a first temperature sensor to detect a temperature of the recording medium as the recording medium passes through the pre-heating unit;

a first heat controller to change an amount of heat energy to be applied to the recording medium per unit area of the recording medium by the pre-heating unit by controlling at least one of heating power of the first heat source and a pressing condition between the heating member and the pressure member, the first heat controller being controlled based on a detection result of the first temperature sensor;

a separation unit to abut the pressure member to the heating member or separate the pressure member from the heating member at a given timing; and a movable transport route to transport the recording medium, the movable transport route being movable to a given position after the separation unit separates the pressure member from the heating member;

wherein when a high gloss mode is not selected, the separation unit separates the pressure member from the heating member, the movable transport route is moved to the given position so that the recording medium is not contactable against the heating member, and the first pressure member is rotated to transport the recording medium.

2. The image forming apparatus according to claim 1, wherein the image forming apparatus produces the image on the recording medium by employing one of a normal mode and the high gloss mode selectable through a selection operation, wherein in the normal mode, the pre-heating unit is not activated and does not heat the recording medium, and wherein in the high gloss mode the pre-heating unit is activated and heats the recording medium to output an image having higher glossiness.

3. The image forming apparatus according to claim 1, wherein the heating member, which is contactable against a transfer face of the recording medium, is heatable by the first heat source, wherein the first pressure member is pressable to the heating member and forms a first nip with the heating member to which the recording medium is transported, and wherein the first heat controller includes at least one of a first heat source controller to change the heating power of the first heat source and a first-nip width adjuster to change a nip width at the first nip.

4. The image forming apparatus according to claim 1, wherein the first pressure member includes an insulation elastic layer.

5. The image forming apparatus according to claim 1, further comprising:

a second heat controller to change an amount of heat energy to be applied to the recording medium per unit area of the recording medium by the fixing unit, the fixing unit including a fixing member, a second pressure member, and a second heat source for heating the fixing member;

wherein the second heat controller changes the amount of heat energy to be applied to the recording medium per unit area of the recording medium by the fixing unit by controlling at least one of heating power of the second heat source and a pressing condition between the fixing member and the second pressure member, and wherein the second heat controller is controlled based on the detection result of the first temperature sensor.

6. The image forming apparatus according to claim 5, wherein the fixing member, contactable against a fixing face of the recording medium, is heatable by the second heat source, wherein the second pressure member is pressable to the fixing member, wherein the second pressure member forms a second nip with the fixing member to which the recording medium is transported, and wherein the second heat controller includes at least one of a second heat source controller to change the heating power of the second heat source, and a second-nip width adjuster to change a nip width at the second nip.

7. The image forming apparatus according to claim 1, further comprising:

a second temperature sensor to detect a temperature of the image carrying member; and a cooling unit to cool the image carrying member;

wherein the cooling unit cools the image carrying member when the second temperature sensor detects that the temperature of the image carrying member exceeds a certain temperature.

8. The image forming apparatus according to claim 1, wherein the image carrying member includes an intermediate transfer belt, wherein the intermediate transfer belt is extended by a secondary transfer counter roller, wherein the secondary transfer counter roller is pressed to a secondary transfer roller via the intermediate transfer belt at the transfer position, and wherein the secondary transfer counter roller includes an insulation elastic layer.

9. The image forming apparatus according to claim 1, wherein the image carrying member is a continuous belt.

10. The image forming apparatus according to claim 1, wherein the image carrying member functions as an intermediate transfer device.

11. The image forming apparatus according to claim 1, wherein the image carrying member comprises an intermediate transfer belt.

12. The image forming apparatus according to claim 1, wherein the transfer unit comprises a secondary transfer roller.

13. The image forming apparatus according to claim 1, wherein the heating member of the pre-heating unit comprises a heat roller.

14. The image forming apparatus according to claim 1, wherein the first pressure member comprises a pressure roller.

15. The image forming apparatus according to claim 1, wherein the fixing unit comprises a heat roller.

16. The image forming apparatus according to claim 1, wherein the fixing unit comprises a fixing member, and wherein the fixing member comprises a fixing belt.

17. The image forming apparatus according to claim 1, wherein the fixing unit comprises a second pressure member, and wherein the second pressure member comprises a pressure roller.

18. An image forming apparatus, comprising:

an image carrying member to carry a toner image thereon;

a transfer unit to transfer the toner image carried on the image carrying member to a recording medium transported to a transfer position;

a pre-heating unit to selectively heat the recording medium before the recording medium is transported to the transfer position, the pre-heating unit including a heating member, a first pressure member, and a first heat source for heating the heating member;

a fixing unit to fix the toner image, transferred to the recording medium at the transfer position, on the recording medium;

a first temperature sensor to detect a temperature of the recording medium as the recording medium passes through the pre-heating unit, a first heat controller to change an amount of heat energy to be applied to the recording medium per unit area of the recording medium by the pre-heating unit by controlling at least one of heating power of the first heat source and a pressing condition between the heating member and the first pressure member, the first heat controller being controlled based on a detection result of the first temperature sensor;

a media type identifier to identify a type of the recording medium transported through the image forming apparatus; and a transport speed controller to change a transport speed of the recording medium transported through the image forming apparatus;

wherein the heating member, which is contactable against a transfer face of the recording medium, is heatable by the first heat source, wherein the first pressure member is pressable to the heating member and forms a first nip with the heating member to which the recording medium is transported, wherein the first heat controller includes at least one of a first heat source controller to change the heating power of the first heat source and a first-nip width adjuster to change a nip width at the first nip, and wherein when a high gloss mode is selected, based on a detection result of the media type identifier, at least one of the first heat source controller, the first-nip width adjuster, and the transport speed controller is controlled.

19. An image forming apparatus, comprising:

an image carrying member to carry a toner image thereon;

a transfer unit to transfer the toner image carried on the image carrying member to a recording medium transported to a transfer position;

a pre-heating unit to selectively heat the recording medium before the recording medium is transported to the transfer position, the pre-heating unit including a heating member, a first pressure member, and a first heat source for heating the heating member;

a fixing unit to fix the toner image, transferred to the recording medium at the transfer position, on the recording medium;

a first temperature sensor to detect a temperature of the recording medium as the recording medium passes through the pre-heating unit;

a first heat controller to change an amount of heat energy to be applied to the recording medium per unit area of the recording medium by the pre-heating unit by controlling at least one of heating power of the first heat source and a pressing condition between the heating member and the first pressure member, the first heat controller being controlled based on a detection result of the first temperature sensor;

a first recording medium detector disposed at an entry side of the pre-heating unit to detect the recording medium, the entry side being an upstream side of a transport direction of the recording medium; and a second recording medium detector disposed at an exit side of the pre-heating unit to detect the recording medium, the exit side being a downstream side of the transport direction of the recording medium;

wherein the image forming apparatus determines a timing to detect the temperature of the recording medium by the first temperature sensor based on a detection result of the first recording medium detector and a detection result of the second recording medium detector.

* * * * *